US007600356B2

(12) United States Patent
Benjamin et al.

(10) Patent No.: US 7,600,356 B2
(45) Date of Patent: Oct. 13, 2009

(54) BUILDING MATERIAL AND METHOD OF MAKING AND INSTALLING THE SAME

(75) Inventors: Michael Putti Benjamin, Colton, CA (US); Andrew John Black, Rancho Cucamonga, CA (US); December Rose Cowen, Rancho Cucamonga, CA (US); Tony Michael Craig, Jr., Lake Elsinore, CA (US); Avril Mary Egan, Etiwanda, CA (US); Weiling Peng, Rancho Cucamonga, CA (US)

(73) Assignee: James Hardie International Finance B.V., Amsterdam (NL)

( * ) Notice: Subject to any disclaimer, the term of this patent is extended or adjusted under 35 U.S.C. 154(b) by 390 days.

(21) Appl. No.: 10/849,279

(22) Filed: May 19, 2004

(65) Prior Publication Data

US 2004/0231252 A1 Nov. 25, 2004

Related U.S. Application Data

(60) Provisional application No. 60/471,700, filed on May 19, 2003.

(51) Int. Cl.
*E04C 2/38* (2006.01)
*E04C 2/34* (2006.01)

(52) U.S. Cl. ..... 52/801.1; 52/461; 52/463; 52/481.1

(58) Field of Classification Search ..... 52/762, 52/781.3, 506.05, 509, 511, 586.1, 591.4, 52/462, 463, 471, 541, 417, 420, 287.1, 288.1, 52/717.06, 69–71, 801.1, 481.1, 461
See application file for complete search history.

(56) References Cited

U.S. PATENT DOCUMENTS

| | | | | |
|---|---|---|---|---|
| 132,345 | A * | 10/1872 | Woolfolk | 52/461 |
| 1,959,519 | A | 5/1934 | Black | |
| 2,062,149 | A | 11/1936 | Stark et al. | |
| 2,222,573 | A | 11/1940 | Reger | |
| 2,253,753 | A | 8/1941 | Black | |

(Continued)

FOREIGN PATENT DOCUMENTS

| | | |
|---|---|---|
| DE | 40 04 103 A1 | 8/1991 |

(Continued)

*Primary Examiner*—Robert J Canfield
*Assistant Examiner*—Christine T Cajilig
(74) *Attorney, Agent, or Firm*—Gardere Wynne Sewell, LLP

(57) ABSTRACT

The building material, in one embodiment, has a jointing system that is uniquely configured to cover the frame of a structure. This building material, in one embodiment, is a building board with a conforming flange that is embossed onto the board and adapted to engage or mate with an end of an adjacent board. In another embodiment, the building material is an engineered panel joint comprised of a building board and a flexible or hinged article attached to the back surface of the building board. The article is preferably attached to the building board by an adhesive and extends beyond the edge and away from the building board for receiving a fastener to fix the building board to the structure. The fastener is preferably a nail. Components of the building material are preferably attached to the frame of the structure through the use of a single row of nails while maintaining or enhancing the shear strength performance of the building board system.

22 Claims, 27 Drawing Sheets

U.S. PATENT DOCUMENTS 2,882,564 A * 4/1959 Couse et al. ..... 52/465
3,047,985 A 8/1962 Cornelius et al.
3,181,662 A 5/1965 Maertzig, Jr.
3,407,786 A 10/1968 Beyer et al.
3,407,985 A 10/1968 Miller
3,444,657 A * 5/1969 Swanson ..... 52/287.1
3,460,860 A * 8/1969 Stevens, Jr. ..... 52/584.1
3,468,092 A 9/1969 Chalmers
3,566,553 A * 3/1971 Kellman ..... 52/57
3,735,596 A 5/1973 Stephenson
3,756,140 A 9/1973 Kolivas
3,797,190 A 3/1974 Widdowson
3,815,310 A 6/1974 Kessler
3,818,961 A * 6/1974 Davey et al. ..... 144/368
3,852,934 A 12/1974 Kirkhuff
3,977,145 A 8/1976 Dobby et al.
3,990,206 A 11/1976 Reusser
4,001,997 A 1/1977 Saltzman
4,018,017 A 4/1977 Schoop
4,034,528 A 7/1977 Sanders et al.
4,094,115 A 6/1978 Naz
4,096,679 A 6/1978 Naz
4,104,840 A 8/1978 Heintz et al.
4,107,896 A 8/1978 Wetzel
4,184,301 A 1/1980 Anderson et al.
4,223,490 A 9/1980 Medow
4,251,967 A 2/1981 Hoofe, III
4,266,382 A 5/1981 Tellman
4,267,679 A 5/1981 Thompson
4,272,939 A 6/1981 Herzfeld et al.
4,301,633 A 11/1981 Neumann
4,327,528 A 5/1982 Fritz
4,424,655 A 1/1984 Trostle
4,433,516 A 2/1984 Fricker
4,529,174 A 7/1985 Pickett
4,546,584 A 10/1985 Mieyal et al.
4,553,366 A 11/1985 Guerin
4,555,885 A 12/1985 Raymond et al.
4,563,381 A * 1/1986 Woodland ..... 428/156
4,619,100 A 10/1986 Emblin
4,669,238 A 6/1987 Kellis
4,712,351 A 12/1987 Kasprzak
4,741,136 A 5/1988 Thompson
4,814,301 A 3/1989 Steinmann et al.
4,877,672 A * 10/1989 Shreiner ..... 428/156
4,879,854 A * 11/1989 Handler ..... 52/238.1
4,930,287 A 6/1990 Volk
4,977,718 A * 12/1990 Hoffman, Sr. ..... 52/287.1
5,050,663 A * 9/1991 Rhoads et al. ..... 160/231.2
5,070,670 A 12/1991 Alderson
5,083,405 A 1/1992 Miller
5,094,051 A 3/1992 Miller
5,115,603 A 5/1992 Blair
5,150,555 A 9/1992 Wood
5,202,994 A 4/1993 Begur et al.
5,224,318 A 7/1993 Kemerer
5,313,755 A * 5/1994 Koenig, Jr. ..... 52/255
5,333,433 A * 8/1994 Porambo et al. ..... 52/417
5,339,608 A 8/1994 Hollis
5,363,623 A 11/1994 King
5,394,672 A 3/1995 Seem
5,406,765 A * 4/1995 Brown ..... 52/409
5,450,694 A * 9/1995 Goranson et al. ..... 52/71
5,496,598 A 3/1996 Delisle et al.
5,502,930 A * 4/1996 Burkette et al. ..... 52/71
5,502,938 A * 4/1996 Backer ..... 52/281
5,564,245 A 10/1996 Rademacher
5,628,158 A * 5/1997 Porter ..... 52/309.9
5,729,946 A 3/1998 Beck
5,857,303 A 1/1999 Beck et al.
5,887,403 A 3/1999 Beck
6,000,185 A 12/1999 Beck et al.
6,014,849 A * 1/2000 Yonemura ..... 52/586.1
6,032,426 A 3/2000 Tamlyn
6,073,406 A * 6/2000 Kearney ..... 52/287.1
6,122,876 A 9/2000 Bado
6,134,855 A 10/2000 Beck
6,151,855 A 11/2000 Campbell
6,170,214 B1 * 1/2001 Treister et al. ..... 52/511
6,178,708 B1 * 1/2001 Porter ..... 52/272
6,315,489 B1 11/2001 Watanabe et al.
6,316,087 B1 11/2001 Lehan
6,332,296 B1 * 12/2001 Moscovitch ..... 52/287.1
6,425,218 B1 7/2002 Doyon et al.
6,488,792 B2 12/2002 Mathien
6,630,531 B1 10/2003 Khandpur et al.
6,719,363 B2 * 4/2004 Erlandsson et al. .... 296/193.07
2001/0004821 A1 6/2001 Kaneko et al.
2001/0025463 A1 * 10/2001 Rudduck ..... 52/474
2001/0047741 A1 12/2001 Gleeson et al.
2002/0023398 A1 2/2002 Ito
2002/0088584 A1 7/2002 Merkley et al.
2002/0158325 A1 10/2002 Yano et al.
2003/0046891 A1 3/2003 Colada et al.
2003/0054123 A1 3/2003 Black et al.
2003/0056458 A1 3/2003 Black et al.
2003/0074846 A1 * 4/2003 Tollenaar ..... 52/122.1
2004/0078890 A1 * 4/2004 Tavivian ..... 4/596
2004/0082700 A1 4/2004 Khandpur et al.

FOREIGN PATENT DOCUMENTS

EP 0 342 886 A1 11/1989
EP 1 020 504 A1 7/2000
GB 1263576 2/1972
GB 1 353 902 5/1974
GB 2 269 833 A 2/1994
JP 03279547 3/1990
JP 0 418 9958 A 7/1992
JP 08218503 8/1996
JP 11247306 A 2/1998
JP 2000170349 12/1998
JP 2002220910 A2 1/2001
WO WO 87/05327 A1 9/1987
WO WO 87/06967 A1 11/1987
WO WO 90/13402 A1 11/1990
WO WO 92/05327 A1 4/1992
WO WO 02/33191 A1 4/2002
WO WO 02/055806 A1 7/2002
WO WO 03/012224 A1 2/2003
WO WO 2004/018799 A1 3/2004

* cited by examiner

BUILDING MATERIAL AND METHOD OF MAKING AND INSTALLING THE SAME

PRIORITY INFORMATION

This application claims priority to U.S. Provisional Patent Application No. 60/471,700, filed May 19, 2003, the entirety of which is incorporated by reference herein.

BACKGROUND OF THE INVENTION

1. Field of the Invention

This invention in one embodiment relates to a building material for covering the frame of a structure, wherein the building material is comprised of a building board having an extending flange adapted to engage an end of an adjacent board to provide a means by which to secure the building board within a system of building boards while improving the shear strength of the system in a cost effective manner.

2. Description of the Related Art

The cladding market uses building boards for covering the frame a structure. The market includes building boards of different materials; in particular, wood, ceramic, metal, plastic or composites of two or more of these. These boards are generally in the form of discreet planks or panels that must be placed adjacent to each other on the frame of a structure in order to cover the structure and thereby provide a protective and decorative covering. In order for this covering to be contiguous, the joints between boards must be treated to appear aesthetically pleasing. This treatment, however, is time consuming and can be expensive. Accordingly, what is needed is an improved building material having a jointing system that reduces the cost and improves the ease of installing building boards. There is also a need in the market for building boards that are, among other things, better at preventing water seepage between the joints, improving the joint strength between building boards, and enhancing the shear strength of the building board system.

Construction industries, such as a residential construction, prefer using nailable building boards for attaching to various types of framing, including wood and metal framing. However, hard, dense or brittle materials, such as ceramic, concrete, stone or thick metal are not nailable and must therefore be attached to wood or steel frames by some other means, such as by providing pre-drilled holes for nails. Drilling holes is time consuming and expensive, so there is a need to reduce installation cost by finding a means of nailing a non-nailable substrate such as ceramic or dense cement composite without pre-drilled holes.

When installing building panels, the panels are butted against each other such that their edges simultaneously cover a framing member. Each panel edge is fastened to the framing member with a row of nails, such that there are two rows of nails at each panel joint. This process is necessary to achieve a minimum level of shear strength as established by building codes. As a way of reducing installation costs, it would be advantageous to minimize the number of nails applied to a panel joint while obtaining comparable or improved shear strength performance as the building board system having two rows of nails at each panel joint.

Nailable materials, such as plywood or OSB panels, that have shiplapped edges may reduce the number of nails needed to merely connect panels together; however, two rows of nails are still needed at each joint of those products in order to maintain the minimum level of shear strength needed to satisfy building codes. For instance, wood-based, shiplapped panels are nailed with two rows of nails; one through the shiplap of the under lapping board and one through the shiplap of the overlapping board to avoid buckling under shear forces. What is needed is a joint treatment using only one row of nails that is resistant to buckling under shear load.

Shiplapped building boards made of fibercement are poor candidates for reducing the numbers of nails needed to connect boards together while maintaining the minimum level of shear strength. Fibercement boards are generally brittle and thus, the shiplapped edges of such boards are prone to breakage during shipment and installation. In addition, it is expensive to machine shiplap joints into the edges of a fibercement panel. What is needed is a means of treating the edges of a fibercement panel to make the edge of the panel less prone to breaking.

Building boards are sometimes sold with a factory applied finish. Often, the finish on these boards is damaged when the boards are nailed to framing members. The building board must be repainted or recaulked (or both) with a coating that matches the original finish. This is a time consuming process and adds cost. Thus, there is also a need for a means of nailing a building board to a framing member that minimizes the damage to the finished surface of the board.

SUMMARY OF THE INVENTION

A building material is provided for covering the frame of a structure. The building material, in one embodiment, is uniquely configured to cover a frame of a structure using a single row of fasteners at each joint or framing element. This building material is preferably a building board with a conforming flange that extends beyond an end of the building board. The conforming flange is preferably embossed onto the building board and adapted to engage or mate with an end of an adjacent building board. The building material may further have a water resistant material deposited between the adjacent building board along the shiplapped joint for managing water seepage.

In an alternative embodiment, the building material may be comprised of an article connected to a building board. The building board can be, but is not limited to, a panel, plank, trim, roofing slate, shake, or tile. In addition, the building board can be made from any one of a number of materials, individually or in combination thereof, including, but not limited to, stone, brick, clay, metal, ceramic, glass, vinyl, fibercement, cement, and PVC. More particularly, a fibercement building board provides especially advantageous properties in a unique configuration. Likewise, the article may be made of any one of a number of materials, individually or in combination thereof, including, but not limited to, stone, brick, clay, metal, ceramic, glass, vinyl, fibercement, cement, and PVC as well as fabrics and fiberglass.

The article preferably acts as a joint extending beyond one edge of the building board for receiving a fastener to fix the building board to the structure. In one embodiment, the article also preferably acts as a flange by which another building material of the same configuration can be easily aligned and secured to the structure. These two building materials work together as a building board system that can be attached to a framing element. This building board system has the capacity of achieving equal or greater shear strength than other building board systems. Preferably, the building board system achieves this level of shear strength by having each building board being nailed to framing members on only 3 edges, thus, reducing the cost and improving the ease of installing the system. The article may also be configured to provide a specific building board system with a specific aesthetic appearance, such as that of a board and batten construction.

The article may be comprised of more than one flange, wherein at least two of the flanges are connected by a hinge or a channel. The hinge is preferably made of a flexible material, such as polymer material, plasticized PVC, nylon mesh or an elastomer, and may be attached to the flanges by any suitable fastening means including, but not limited to, chemical bonding, mechanical bonding, thermal bonding, and adhesives such as a hot melt polyurethane glue. The hinge may also be co-formed with at least one of the flanges for example by co-extrusion, pultrusion or injection molding. The hinge preferably allows at least one of the flanges to rotate around the hinge and lie next to the flange attached to the building board or in a plane substantially parallel with the building board, which improves the strength of the joint. The hinge also provides flexibility to the joint, which helps to prevent damage resulting from packaging and shipping the building material.

The article may be attached to the building board by any suitable chemical, thermal or mechanical means. For instance, the article may be bonded to the building board using any suitable adhesive including structural adhesive, polyurethane glue, hot melt polyurethane adhesive, epoxy adhesive, acrylic foam, polyurethane foam, pressure sensitive adhesive, pressure sensitive foam adhesive (e.g., butyl rubber or acrylic foam), silicone caulk and polyurethane caulk. The adhesive may be applied as a layer between the article and the building board. In one embodiment, the adhesive may be incorporated into the body of the article and activated when the article is pressed against the building board. In another embodiment, the adhesive is also activated by heat. In another embodiment the article is a polymeric material and a solvent is used to swell and adhesively bond the polymer to the building article The channel may be made of a rigid material such as metal and may be attached to the flanges by any suitable fastening means including chemical bonding, mechanical bonding, thermal bonding, and adhesives. The channel preferably rests between the adjacent ends of the building boards to provide a region for fastening the building board system to a framing element. To further improve the shear strength of the building board system, a jointer compound may be added between the edges of the building board system and/or in the channel connecting adjacent building boards.

The building boards may further have beveled edges and/or notches and tabs. The beveled edges and/or notches cause to interlock with adjacent boards to form a building board system with improved shear strength while improving the ease of installation of the boards.

The building material may be configured in other embodiments. For instance, the building material may be configured with angled edged building boards which help to reduce the conspicuousness of the seams between building boards. The building boards are preferably formed with angles along opposite edges, e.g., top and bottom edges or opposing side edges, so that the edges of adjacent building boards overlap when installed. This overlapping feature along the edges of the building board, in conjunction with the hinged article, helps to make the joint less conspicuous by allowing the edges of each board to slidingly engage with each other as the boards expand or contract from exposure to heat, cold or changing moisture content. The angled edges also help to reduce installation time by providing a means by which the building boards can be easily aligned and fixed to the framing members.

Likewise, in another embodiment, a building material is provided with a fibercement board having a surface and opposing edges and an article connected to the surface of the board. The article extends beyond at least one of the opposing edges and is adapted to receive a fastener to fix the board to the structure. The article has at least a first flange connected to the panel and a second flange extending beyond one of the opposing edges, the second flange being capable of moving relative to the first flange.

In a further embodiment, a building material is provided with at least two strips of material. Each strip of material has a surface, wherein the at least two strips are adjacent each other and connected together along an edge. The building material is further provided with a board having a substantially planar surface and opposing ends, wherein the surface of one of the at least two strips of material is connected to a surface of the board along one of the opposing ends of the board. One of the at least two strips of material is configured to extend beyond one of the opposing ends of the board, wherein the extending strip is capable of movement relative to the strip connected to the board.

In a further embodiment, a system of building materials is provided with at least two boards connected to a framing element, wherein one of the boards is a main board and a second of the at least two boards is an adjacent board. The at least two boards each have a surface, opposite ends, and opposite edges. The system is further provided with an article connected to the main board surface along one of the opposite ends of the main board, wherein the article has at least one flange parallel with the main board surface, the at least one flange extending beyond one of the opposite ends of the main board. The system is further provided with a row of fasteners extending at least through the article to the framing element, wherein the row of fasteners extending through the article secures the main board and the adjacent board relative to the framing element.

The various embodiments of the building material may be installed in numerous ways. In one embodiment, a method of installing a system of building materials is provided, which comprises selecting a first board having at least one flange extending from at least one of the opposing edges and away from the first board, positioning the first board on a framing element of the structure such that a surface of the article rests along an outward facing surface of the framing element, selecting a second board having a surface and opposing edges, aligning the second board on the framing element of the structure, wherein at least one of the opposing edges of the second board is adjacent one of the edges of the first board and fastening the article to the framing element causing to relatively secure the first board and second board to the framing element. In another embodiment, the method and system involves fastening the article to the framing member using only one row of nails at each board joint.

These and other objects and advantages will become more fully apparent from the following description taken in conjunction with the accompanying drawings.

DETAILED DESCRIPTION OF THE PREFERRED EMBODIMENTS

Figure 1A:
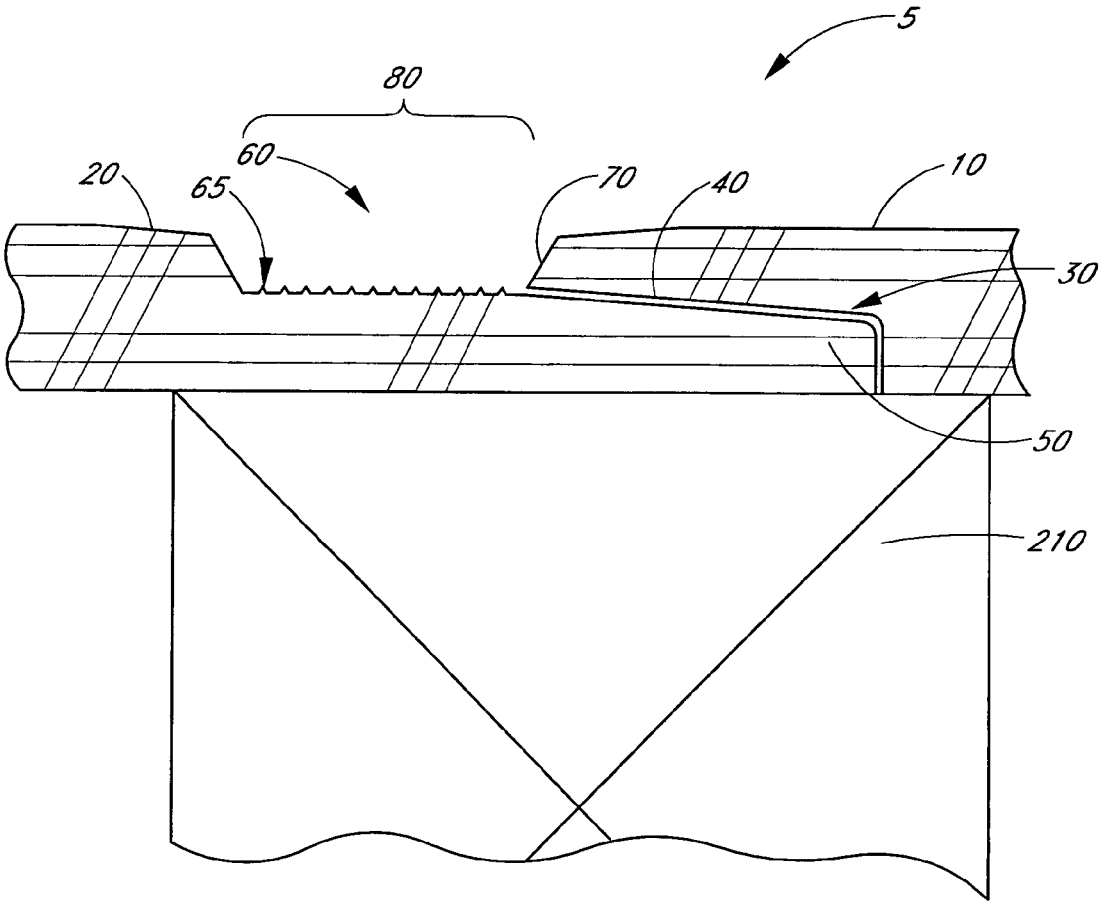
FIG. 1A shows a cross sectional elevation view of one embodiment of a system of building materials with two shiplapped building boards in contact with each other at a framing element.
Figure 1B:
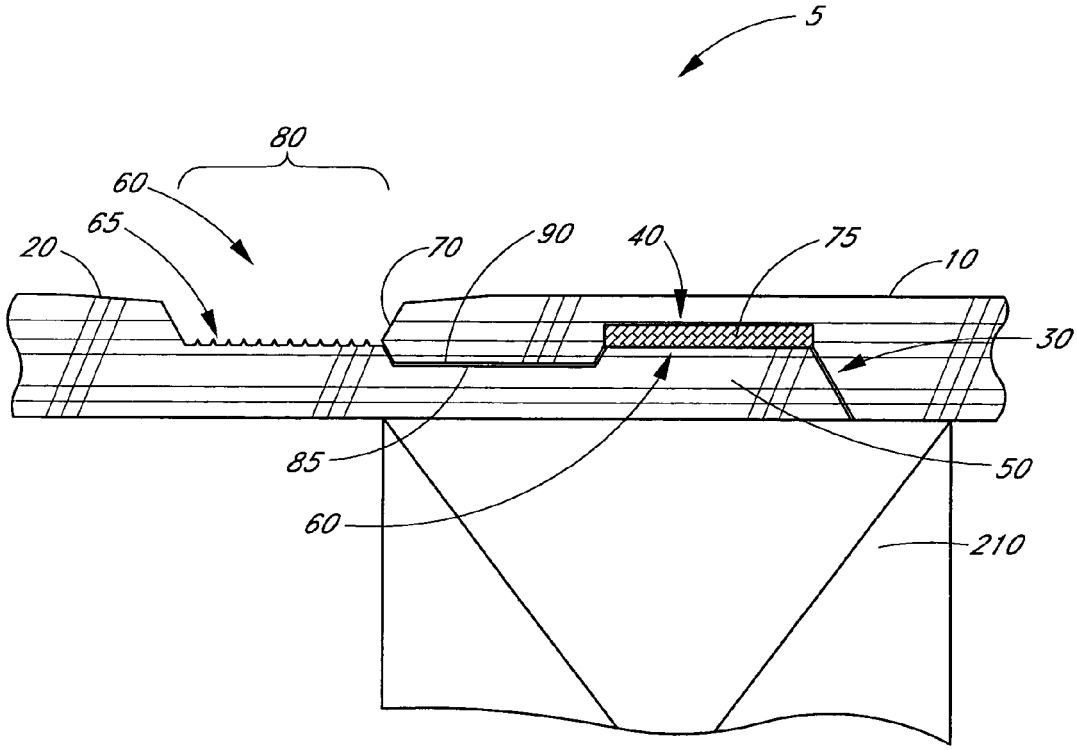
FIG. 1B shows a cross sectional elevation view of one embodiment of a system of building materials with two shiplapped building boards interlocked together at a framing element.
Figure 1C:
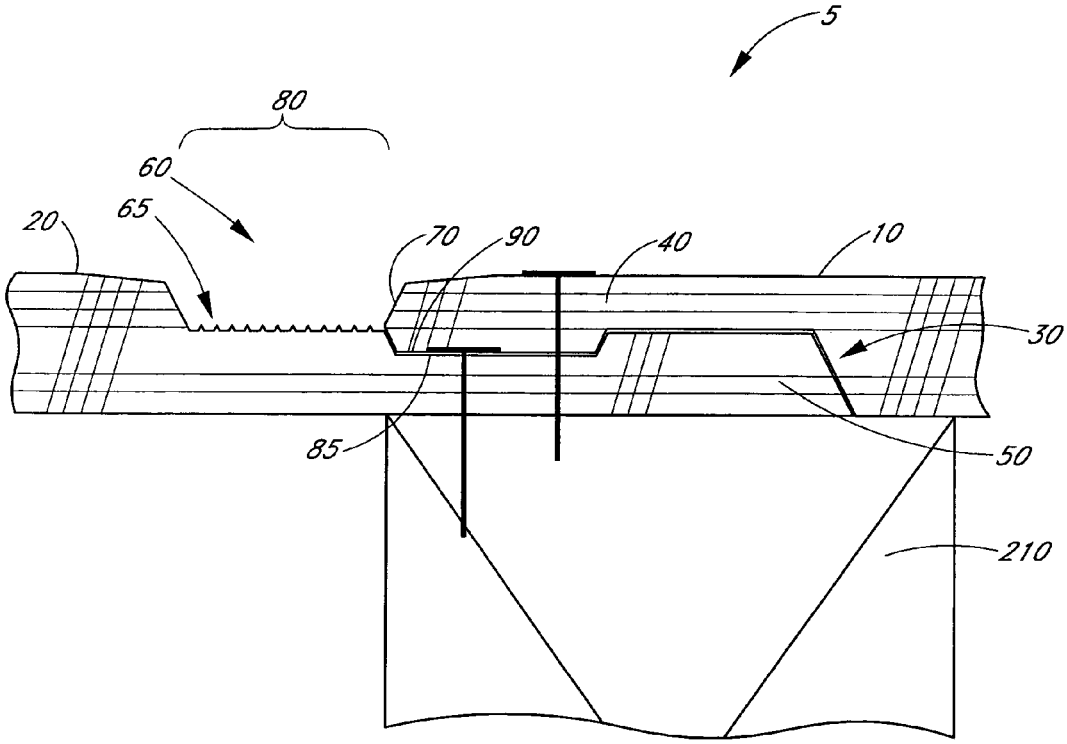
FIG. 1C shows a cross sectional elevation view of a system of building materials of FIG. 1B affixed to the framing element by means of at least one nail.

In one embodiment, the building material 5 comprises at least one shiplapped building board. The building material is preferably rabbeted so that the edge of one board 10 overlaps an adjacent board 20 to create a substantially flush joint 30 as shown in FIGS. 1A, 1B, and 1C. The building boards are preferably made of fibercement but can be made of any suitable material including stone, brick, clay, metal, ceramic, glass, vinyl, cement, plastic or composites thereof. In addition, the shiplapped joint may be applied to panels, planks, roofing slates or shakes, tiles, and flooring boards.

The joint 30 preferably comprises a cut or groove 40 along a surface near at least end of the building board 10 adapted to receive the end 50 of an adjoining building board 20. Alternatively, the end 50 of the adjoining board 20 may be adapted to receive the unique configuration of the cut or groove 40. For instance, the end 50 of the board 20 shown in FIG. 1A has a recess 60 adapted to receive the cut or groove 40 of the building board 10. The recess 60 and the cut or groove 40 help to form the joint 30. The cut or groove 40 and the recess 60 of the building material 5 may be formed in any suitable manner. For instance, the recess 60 and cut or groove 40 may be embossed onto a fibercement greensheet during the formation process.

Optionally, a portion of the recess 60 may be left uncovered by the cut or groove 40 of building board 10 as shown in FIGS. 1A, 1B, and 1C. When this is done, a batten 80 is preferably formed as a result of the exposed portion of the recess 60 and the end 70 of building board 10. The batten 80 is an ornamental feature of the system that can be further enhanced by molding, scoring, embossing, or extruding decorative elements such as the ribs 65 shown in FIGS. 1A, 1B, and 1C.

In addition to enhancing the look of the system, the building material may further provide for water management between adjacent building boards 10, 20. For instance, in FIG. 1B, a water resistant material 75 may be deposited between the surface of the groove 40 and the recess 60. The water resistant material 75 provides for a space for channeling water away that may seep into the system.

FIG. 1C is an alternative embodiment of the shiplapped building board. The recess 60 further comprises a channel 85 for receiving a protruding member 90 of building board 10. The channel 85 and protruding member 90 assist in interlocking the adjacent building boards 10, 20 and help to improve the shear strength of the system. The channel 85 also provides an indicator for fastening the building board 20 to the framing element 210. Although the fastener is preferably applied on the recess 60 of the building board 20 so that the groove 40 of the adjacent building board 10 covers the fastener and provides for blind fastening, the fastener may also be applied through the adjacent building boards 10, 20 to the framing element 210 at the joint 30.

To further improve the shear strength of the system, a bonding material may be applied between the surfaces of the groove 40 and the recess 60. The bonding material may be selected from any suitable material including structural adhesive, polyurethane glue, hot melt polyurethane adhesive, epoxy adhesive, acrylic foam, polyurethane foam, pressure sensitive adhesive, pressure sensitive foam adhesive (e.g., butyl rubber or acrylic foam), silicone caulk and polyurethane caulk. Adding bonding materials, such as a pressure sensitive adhesive, between the groove 40 and the recess 60 of the joint 30 will assist to restrict out of plane movement of the building boards and help prevent buckling at the joint between the building boards. In addition, the bonding material will assist in allowing building material 5 to attain higher shear load values, including instances where one row of fasteners is used to secure the building material 5 to framing member 210.

The shiplapped building boards provide a substantially rigid connection that allows for transfer of loads across joints enabling the system to act more like a single board. For instance, in a test of a system employing shiplapped boards attached to framing elements on a 6"×12" nailing pattern (e.g., 6 inch intervals along the perimeter of the building board by 12 inch intervals within the field of the building board), the system deflected only ⅛ of an inch upon application of a load over 280 lbs/ft. The minimum shear strength of a system employing shiplapped building boards is 270 lbs/ft.

Figure 2A:
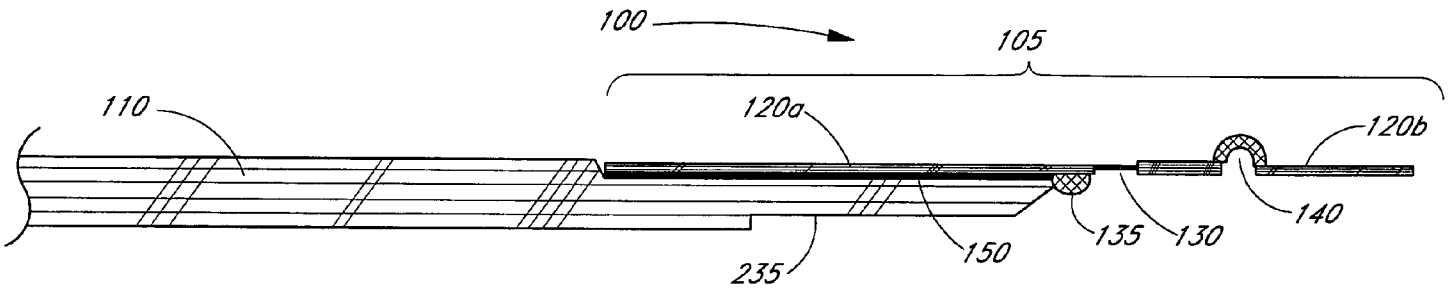
FIG. 2A shows a cross sectional elevation view of one embodiment of a building material with a hinged flange having a capillary break adhered to an edge of a building board.

In another embodiment, the building material comprises an engineered panel joint 100 as shown in FIG. 2A, which is pre-fabricated by a manufacturer and is sold ready to be installed by the builder. The engineered panel joint 100 is comprised of an article or joint 105 and a building board 110, such as, but not limited to, a panel, plank, trim, roofing slate, shake, or tile. The building board 110 can be made of a variety of materials, such as wood, metal or plastic. The building board 110 may also be made of a non-nailable material, including but not limited to, stone, ceramic or metal. Alternatively the building board 110 may also have either a factory applied finish or a finish applied in the field prior to installation. In one embodiment, the building board 110 is preferably made from fibercement. Fibercement advantageously has the preferred qualities of non-combustibility, strength, nailability and durability. Low-density fibercement has additional advantages over higher density fibercement because the material is more easily machined, and its decrease weight facilitates handling and installation.

The joint 105 is preferably affixed to the building board 110 by means of an adhesive 150, more preferably an adhesive capable of adhering a fibercement board to the joint, such as, but not limited to, a hot melt moisture cured polyurethane, polyurethane glue, pressure sensitive foam, rubber tape, and elastomeric tape with fabric backing. However, the joint 105 could be the result of embossing or forming a flange along an end of a building board that provides an interlocking region integral with and conforming to the building board; the flange adapted to receive the end of an adjacent building board.

The joint 105 of FIG. 2A is preferably comprised of two flanges 120*a* and 120*b* connected by a hinge 130; however, the joint may be comprised of an integrated flange that can be directly adhered to the building board 110 and/or the framing element 210 without the intervening adhesive 150. The flange is preferably made of a flexible material, such as a mesh made of fabric and fiberglass, but could also be made from a rigid material such as metal. The individual components of the engineered panel joint 100, such as the unique characteristics of the adhesive and fibercement, are further discussed and described in U.S. Pat. No. 6,572,697, U.S. Pat. No. 6,676,744, U.S. Pat. No. 6,689,451, U.S. Pat. No. 6,030,447, U.S. Patent Publication No. 2003-0056458, U.S. Patent Publication No. 2003-0046891, and U.S. Patent Publication No. 2003-0054123, which are hereby incorporated by reference in their entirety and considered a part of the detailed description disclosed herein.

In one embodiment, the joint 105 shown in FIG. 2A is affixed to only one edge of the pre-fabricated and pre-installed building board 110. It will be appreciated that in alternative embodiments, the joint 105 may be affixed to two opposing edges of a board, or even additional edges. The joint 105 is configured to also be affixed to the edge of an adjoining building board such as the building board 220 shown in FIGS. 2B, 3 and 4. As with the building board 110, the building board 220 could be manufactured with its own joint comprising a pair of flanges connected by a hinge. In addition, as with the adhesive 150 used to connect the joint 105 to the building board 110, the same adhesive 150 could be used to connect the joint 105 with the building board 220. As mentioned above, the adhesive 150 is preferably a hot melt polyurethane glue but can be made from any elastomeric material that compensates for differential movement between surfaces with dissimilar coefficients of thermal expansion. such as a cementitous surface and a plastic surface or metallic surface. For instance, the bonding material can be a pressure sensitive adhesive tape that can be installed in a hot melt or cold setting.

The flanges 120*a*, 120*b* can be made of a variety of different materials such as metal, rubber or an elastomer, but are preferably made from PVC, and are preferably connected by a hinge 130 that is flexible. The flexible hinge 130 is preferably made from a plasticized PVC material but can be made from any material that is flexible such as plasticized polymers, natural or synthetic rubbers, metal, or elastomeric materials. Although the flanges 120*a*, 120*b* of one preferred embodiment are made from the same material, the flanges 120*a*, 120*b* can be made from two separate materials. For instance, the flange 120*a* can be made from an elastomer while the flange 120*b* can be made from a plastic material such as PVC. In addition, even though the hinge 130 of the preferred embodiment is a different material from the flanges 120*a*, 120*b*, the hinge can be the same material as one or both of the flanges.

Figure 2B:
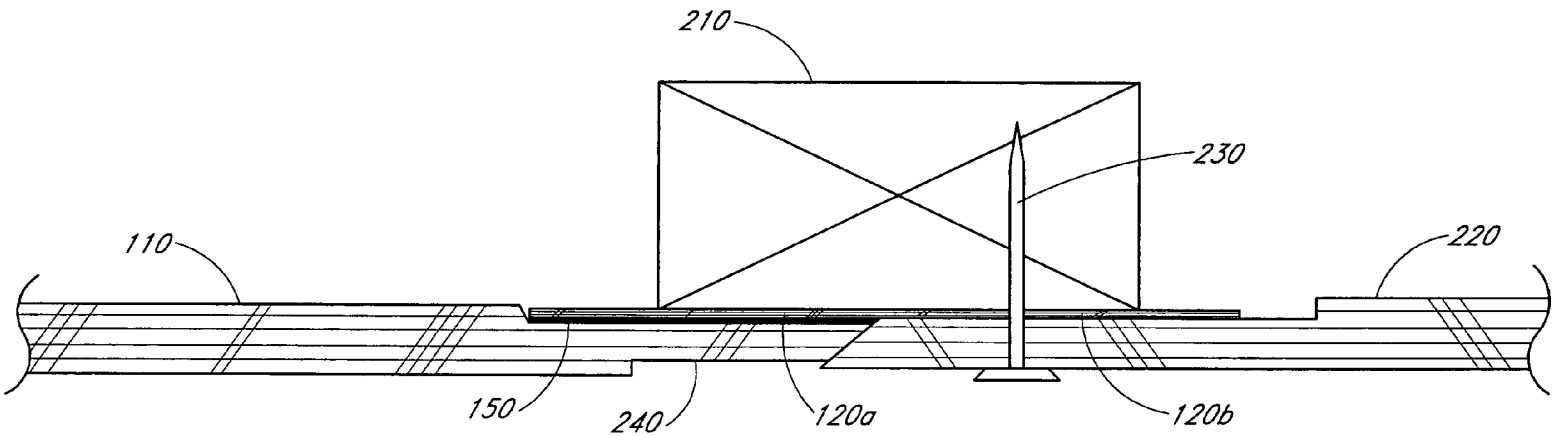
FIG. 2B shows a cross sectional elevation view of a building material of FIG. 2A affixed to a framing element and a separate building board by means of a nail.

The hinge 130 is preferably positioned between the flanges 120*a*, 120*b* to allow the flange 120*b* to move or rotate about the hinge 130 and lie along a plane that is substantially parallel with the flange 120*a* and/or flush against the building board 110. However, the hinge 130 can take the place of one of the flanges. For instance, the flange 120*a* can be substituted for a longer and/or wider version of the hinge 130 such that the hinge may be directly adhered to the building board 110 as well as connect the building board with the flange 120*b*. The hinge 130 provides a means by which the engineered panel joint 100 may be easily packaged at the production site and shipped to the installation site while reducing the risk that the flanges 120*a*, 120*b* will snap off from the building board 110 or break in half. In addition, the hinge 130 also provides some give between the connected building boards 110, 220, as shown in FIG. 2B, so as to minimize the risk of cracking between the joint when the framing element 210, wherefrom the building boards are connected, moves with a settling structure.

Figure 9A:
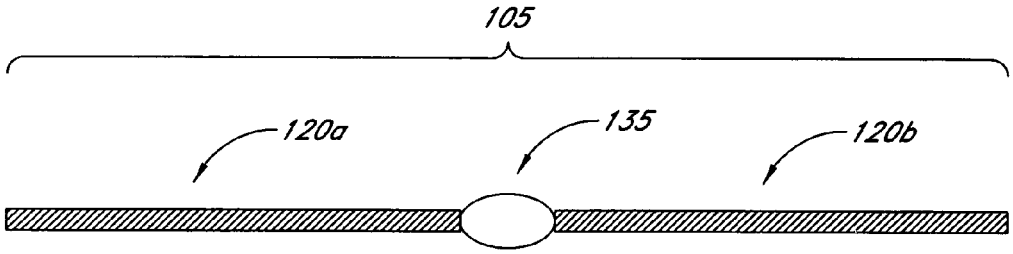
FIG. 9A is a cross sectional elevation view of one embodiment of the joint with a substantially oval bead between the flanges, wherein the bead may serve as a hinge.
Figure 9B:
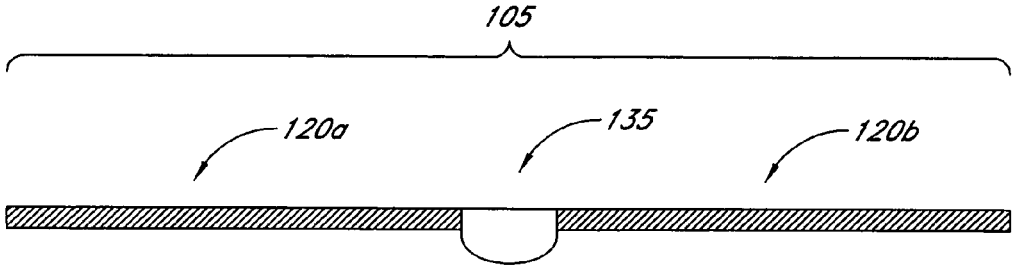
FIG. 9B is a cross sectional elevation view of one embodiment of the joint with a substantially semi-oval bead between the flanges, wherein the bead may serve as a hinge.

An additional bead 135 may be added along the edge of building board 110 as shown in FIG. 2A to help protect the joint 105 and still allow movement between the flanges 120*a*, 120*b*. This bead 135 also helps to form a seal when the building board 110 is connected with another building board 220 as shown in FIG. 2B. The bead 135 is preferably resilient and/or a deformable polymeric material such as silicone rubber so that it may conform to and fill the interstices between the building boards 110, 220 and to help protect against environmental elements, such as water, from seeping through the joint 105. The bead 135, however, could also be made from plasticized PVC or silicone. The bead 135 is preferably co-extruded with the joint 105 as shown in FIGS. 9A and 9B, but may also be applied after the joint 105 is attached to the building board 110 either at manufacture or during installation. However, the presence of the bead 135 helps to minimize the need for caulking as a sealant and the additional step of applying caulking when installing the building boards to a structure.

FIGS. 9A and 9B show the joint 105 with the two flanges 120*a*, 120*b* co-extruded with the bead 135. In this embodiment, the bead 135 acts as a hinge as well as a retarding water ingress between the building boards 110, 220 and between the joint 105 and the framing element 210. Thus, the bead 135 could, in essence, replace the hinge 130 of the embodiment shown in FIG. 2A.

In FIG. 9A, the bead 135 is shown having a substantially oval shape between the flanges 120*a*, 120*b*. The oval shape of the bead 135 allows the bead to fill the interstices between the building boards 110, 220 as well as the interstices between the joint 105 and the framing element 210. In FIG. 9B, the bead 135 is shown having roughly a semi-oval shape with one surface of the bead 135 being substantially flush with the surfaces of the flanges 120*a*, 120*b*. The embodiment shown in FIG. 9B allows the joint 105 to potentially rest along a plane that is more flush with the framing element 210 than the embodiment shown in FIG. 9A.

In each of the embodiments, however, the bead 135 can be the made from the same material as the flanges 120*a*, 120*b* or from a substantially different material than the flanges 120*a*, 120*b*. In one embodiment, the bead 135 is made from substantially the same material as the flanges 120*a*, 120*b*, but is generally more pliable and flexible than the flanges 120*a*, 120*b*. In this embodiment, the flanges 120*a*, 120*b* are preferably rigid or stiff. In an alternative embodiment, the bead 135 is made from substantially the same material and has substantially the same material properties as the flanges 120*a*, 120*b*. In this embodiment, the bead 135 and the flanges 120*a*, 120*b* are both preferably flexible and/or pliable. In a further embodiment, the bead 135 is made from a material that is substantially different from the flanges 120*a*, 120*b*, wherein the flanges are rigid and the bead is flexible and/or pliable.

Figure 10A:
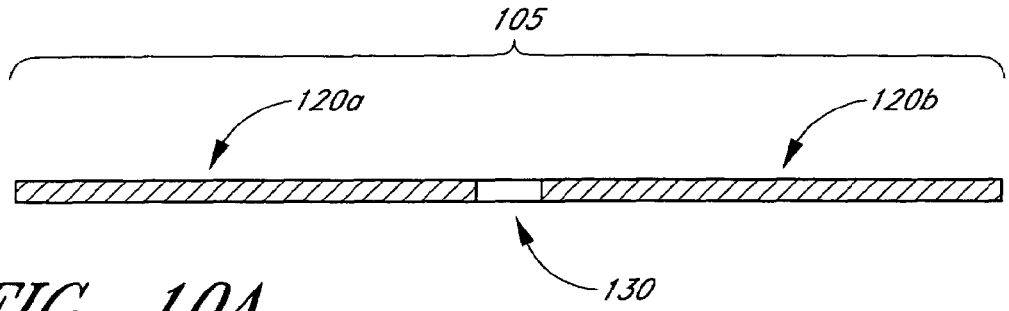
FIG. 10A is a cross sectional elevation view of one embodiment of the joint with a hinge between and substantially in the same plane as the flanges.
Figure 10B:
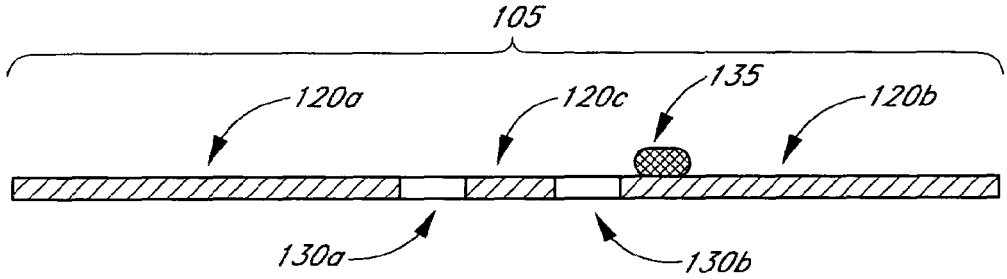
FIG. 10B is a cross sectional elevation view of one embodiment of the joint having two hinges between the flanges, wherein one of the flanges has a bead.
Figure 10C:
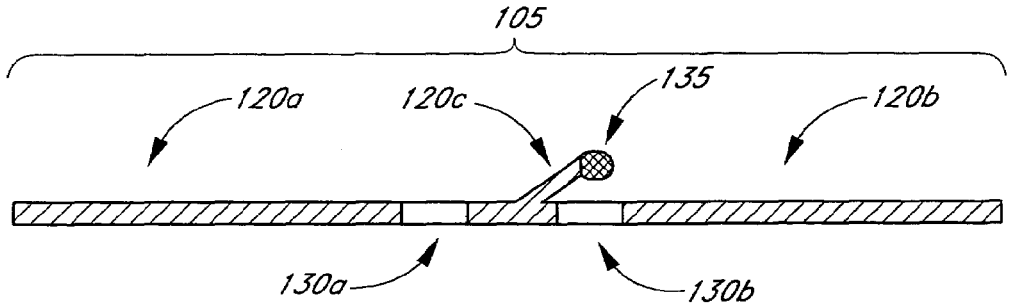
FIG. 10C is a cross sectional elevation view of one embodiment of the joint having two hinges between the flanges, wherein one of the flanges has a bead at the end of an extending member.

In an alternative embodiment of the building material, the building boards are connected to joints that are substantially similar to the joints 105 shown in FIGS. 10A, 10B, and 10C.

The joint 105 of FIG. 10A has a hinge 130 that is disposed between flanges 120*a*, 120*b*. The flanges 120*a*, 120*b* are normally substantially planar with the hinge 130; however, the hinge 130 is preferably made of a flexible material allowing flange 120*b* to move relative to flange 120*a*. A system of building materials employing the joint of FIG. 10A has improved shear strength capabilities. For instance, in a test of one embodiment of a system of building materials employing the joint of FIG. 10A, the system was able to deflect only an eighth of an inch under a load of 200 pounds per foot based on a 6"×12" nailing pattern (e.g., approximately 6 inch intervals around the perimeter and roughly 12 inch intervals in the field).

The joint 105 of FIG. 10B has two hinges 130*a*, 130*b* spaced between three flanges 120*a*, 120*b*, 120*c*. Hinge 130*a* is disposed between flanges 120*a* and 120*c* while hinge 130*b* is disposed between flanges 120*b* and 120*c*. Hinges 130*a*, 130*b* are preferably made from a flexible material allowing flanges 120*a* and 120*b* to move relative to flange 120*c*. The joint 105 of FIG. 10B also preferably has a bead 135 on flange 120*b* to retard water ingress between the joint 105 and the framing element, and adjacent building boards. The bead 135 is preferably resilient and/or a deformable polymeric material such as silicone rubber.

A system of building materials having a joint with a dual hinge system assists in improving the shear strength characteristics of the building material. For example, a ASTM E72-02 Section 14 test of a system utilizing a joint substantially similar to the joint 105 of FIG. 10B exhibited increased shear strength. Based on that test using a 6"×12" nailing pattern, a system with boards having a thickness of ⅜ of an inch is able to withstand a load of approximately 150 pounds per foot or more. For instance, in a test of one embodiment of the system of building boards employing the joint of FIG. 10B, wherein a hot-melt polyurethane was used to adhere the joints to building boards having a 45 degree edge bevel, the system was able to withstand an ultimate load of greater than 200 pounds per foot and deflect only an eighth of an inch at approximately 154 pounds per foot. In a test of another embodiment of the system of building boards employing the joint of FIG. 10B, wherein a hot-melt polyurethane was used to adhere the joints to building boards having a 30 degree edge bevel, the system was able to withstand an ultimate load of greater than 200 pounds per foot and deflect only an eighth of an inch between approximately 150 and 170 pounds per foot. In a test of another embodiment of the system of building boards employing the joint of FIG. 10B, wherein a polyurethane glue was used to adhere the joints to building boards having a 30 degree bevel, the system was able to withstand an ultimate load of greater than 244 pounds per foot and deflect only an eighth of an inch at approximately 195 pounds per foot.

A system with boards having a thickness of ½ of an inch and attached to a structure according to a 6"×12" nailing pattern is able to withstand a load of approximately 250 pounds per foot or more. For instance, in a test of one embodiment of the system of building boards employing the joint of FIG. 10B, wherein a hot melt polyurethane was used to connect the joints with building boards having a 30 degree bevel, the system was able to withstand a load greater than 270 pounds per foot and deflect only an eighth of an inch at approximately 260 pounds per foot.

The joint 105 of FIG. 10C also has two hinges 130*a*, 130*b* spaced between three flanges 120*a*, 120*b*, 120*c*. Hinge 130*a* is disposed between flanges 120*a* and 120*c* while hinge 130*b* is disposed between flanges 120*b* and 120*c*. Hinges 130*a*, 130*b* are preferably made from a flexible material allowing flanges 120*a* and 120*b* to move relative to flange 120*c*. The joint of FIG. 10C also preferably has a bead 135 along an extending member of flange 120*c*. The surface of extending flange 120*c* is preferably parallel to the beveled edge of the building material (e.g., if the beveled edge of the building board is angled at approximately 30 degrees, the extending flange 120*c* is preferably angled at approximately 30 degrees). The extending member of flange 120*c* preferably acts as a means for managing water between adjacent boards. The bead 135 preferably acts as a sealant between the joint 105 and the framing element, and adjacent building boards. The bead 135 is preferably resilient and/or a deformable polymeric material such as silicone rubber.

A system of building materials employing the joint of FIG. 10C has improved shear strength capabilities. For instance, in a test of one embodiment of a system of building materials employing the joint of FIG. 10C, wherein a hot-melt polyurethane was used to adhere the joints to building boards having a 45 degree bevel, the system was able to deflect only an eighth of an inch under a load of 150 pounds per foot.

Figure 11:
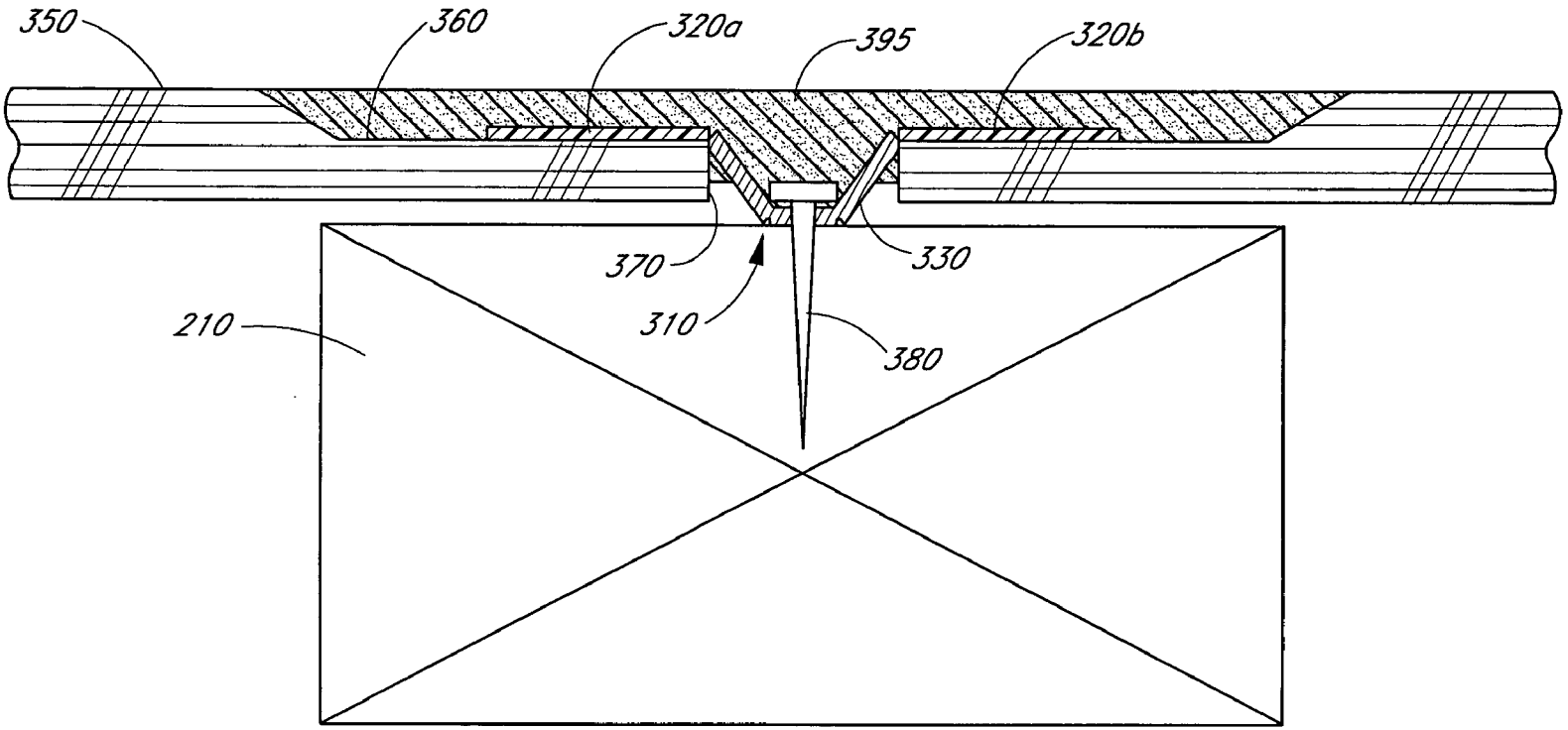
FIG. 11 is a cross sectional elevation view of one embodiment of a system of building materials, wherein the building boards are connected by a jointer and a jointing compound.
Figure 12:
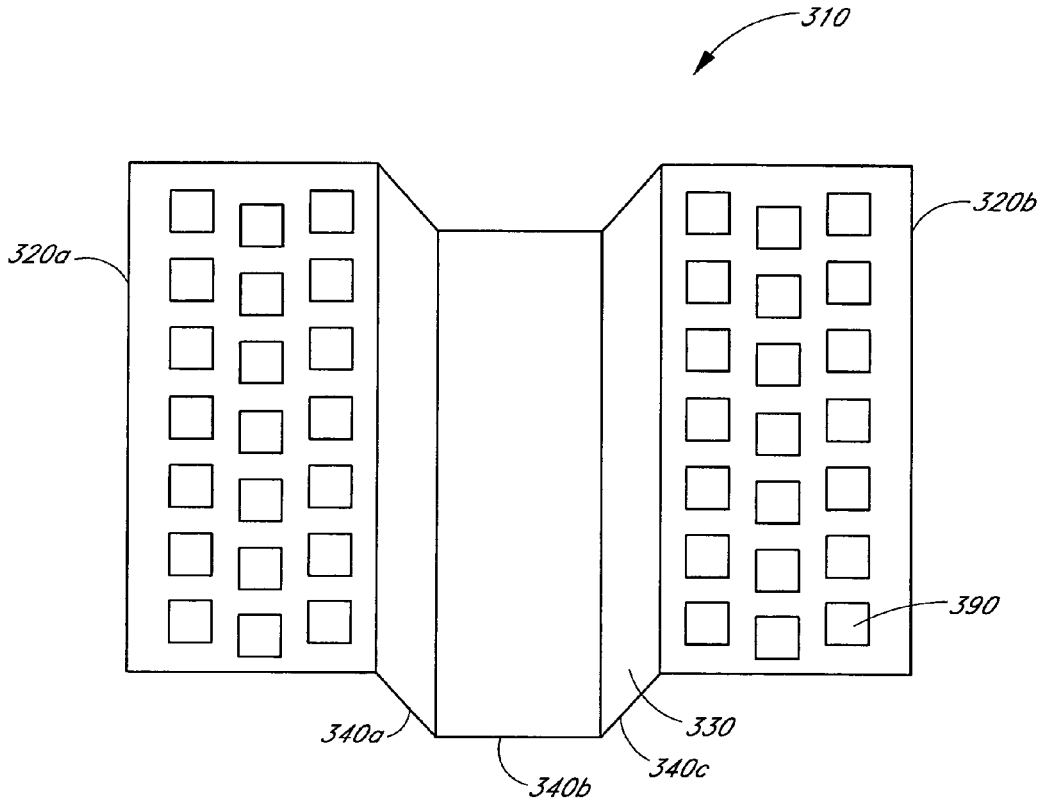
FIG. 12 is a perspective view of one embodiment of the joint, wherein the joint is a jointer having at least two flanges with perforated surfaces.

In an alternative embodiment, the joint includes a jointer 310 as shown in FIGS. 11 and 12 having at least two strips of material or flanges 320*a*, 320*b* that are substantially in the same plane connected together by way of a channel 330 formed of at least three strips of material or flanges 340*a*, 340*b*, 340*c*. The flanges 320*a*, 320*b* are preferably made of the same material as the channel 330, such as metal, but could be made of different materials. For instance, the flanges 320*a*, 320*b* may be made of a more flexible material such as a fabric or a fiberglass mesh, plasticized polymers, natural or synthetic rubbers, or elastomeric materials, while the channel 330 could be made of a more rigid polymeric material or metal. The flanges 320*a*, 320*b* are preferably attached to the building board 350 along recessed portions 360 along the ends of the building board. The recessed portions 360 may be machined after the building board 350 is cured or may be molded or extruded when the building board is formed. The channel 330 rests between the ends 370 of adjacent building boards 350 and forms a fastening region from which the adjacent boards are connected to a framing element 210. The jointer 310 is preferably attached to the framing element 210 using standard nails 380 spaced six inches apart. The jointer 310 assists in providing a strong mechanical connection between the framing element 210 and the building boards 350 by way of a fastening means such as nailing.

The flanges 320*a*, 320*b* of the jointer 310 may be attached to the building board 350 by any suitable means, including adhesives, mechanical bonding, and chemical bonding. In an alternative embodiment, the flanges 320*a*, 320*b* of the jointer 310 have perforations 390 as shown in FIG. 12. The perforations 390 assist in providing a strong connection between the recessed portions 360 of the building boards 350 and the jointer 310. In addition, a jointing compound 395 may also be used to assist with connecting the jointer 310 with the building board 350 as shown in FIG. 11. The jointing compound 395 is preferably an epoxy-based tile adhesive, although other jointing compound formulations may also be used. The jointing compound 395 may adhere the jointer 310 to the recessed portions 360 through the perforations 390 in the jointer 310. In addition, the jointing compound 395 may help to establish a rigid joint across the edges of adjacent building boards 350 in the building system and enhance shear resistance.

The building board is preferably made from fibercement, but can be made of a variety of materials such as metal, wood, or plastic. The building board may also be made of a non-nailable material, including but not limited to, stone, ceramic or metal. Alternatively the building board may also have either a factory applied finish or a finish applied in the field prior to installation.

Figure 8:
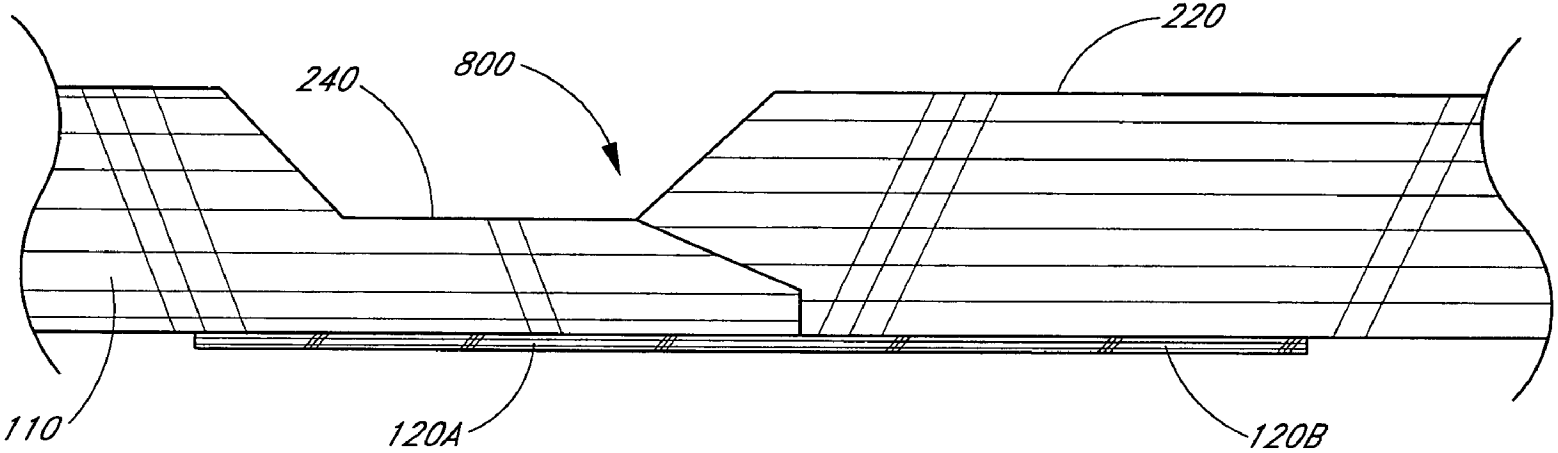
FIG. 8 is a cross sectional elevation view of one embodiment of the building material having a compound angle affixed to a separate building board.

The building board preferably has edges angled between 30° and 60°, but the edges may also be angled between 90° and 180°. For instance, an edge of building board 110 could be manufactured with a compound angle as shown in FIG. 8. A building board edge having a compound angle helps with creating a secure connection between a system of building boards to a structure. In one instance, the compound angle 800 improves the shear strength and weatherability of the building board system. The compound angle 800 also gives the appearance of a batten in the board and batten construction.

The angles along the edges of the building board help to further provide adequate overlap between two adjoining or adjacent building boards such as the building boards 110 and 220 shown in FIG. 2B. The overlap is one means by which the building board system may compensate for movement between the building boards as a result of such external effects as weathering or settling. For instance, the overlap helps to minimize the risk of the framing element 210 from becoming exposed if the building boards 110, 220 are caused to move in a direction away from each other; in such a situation, the edge of building board 110 will shield the framing element.

The edges of the building board 110 are preferably designed with recessed portions to receive the flange 120*a*, but the edges could be manufactured without recess portions. If the edges of the building board 10 have recessed portions, the recessed portions are preferably no deeper or longer than necessary to adhere the flange 120*a* to the building board 110 and allow the top surface of the flange 120*a* to be flush with the top surface of the building board 110. While the illustrated embodiment has recessed portions along the edge of the building board 110 to avoid unevenness when the flange 120*a* is adhered to the building board, the building board could be manufactured having no recessed portions.

Figure 3:
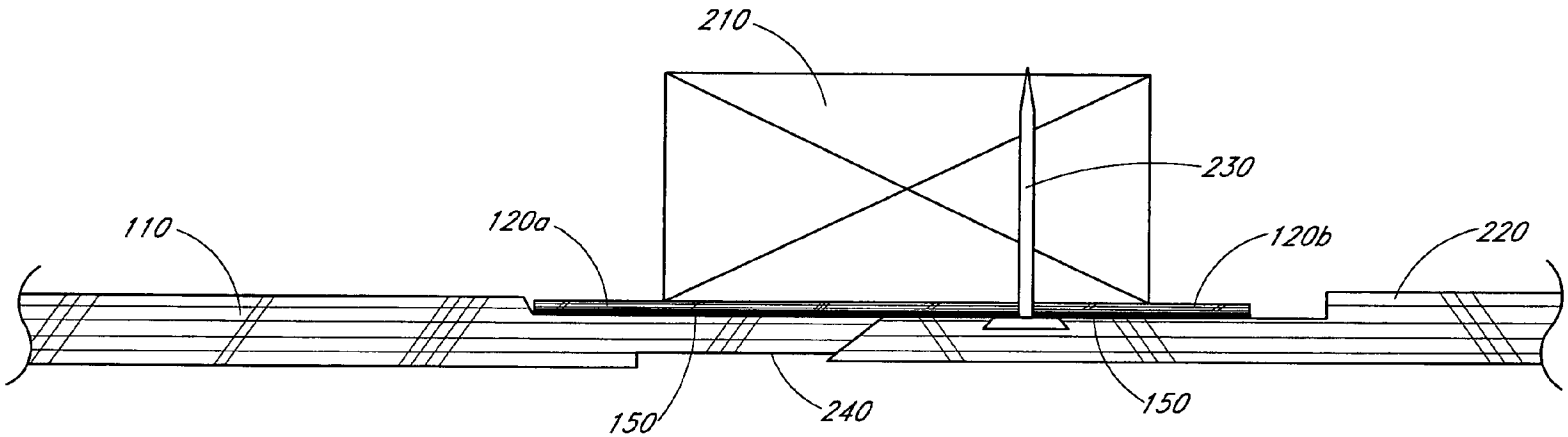
FIG. 3 shows a cross sectional elevation view of the building material of FIG. 2A wherein the flange is affixed to a framing element by means of a nail and is further affixed to a separate building board by means of an adhesive.
Figure 4:
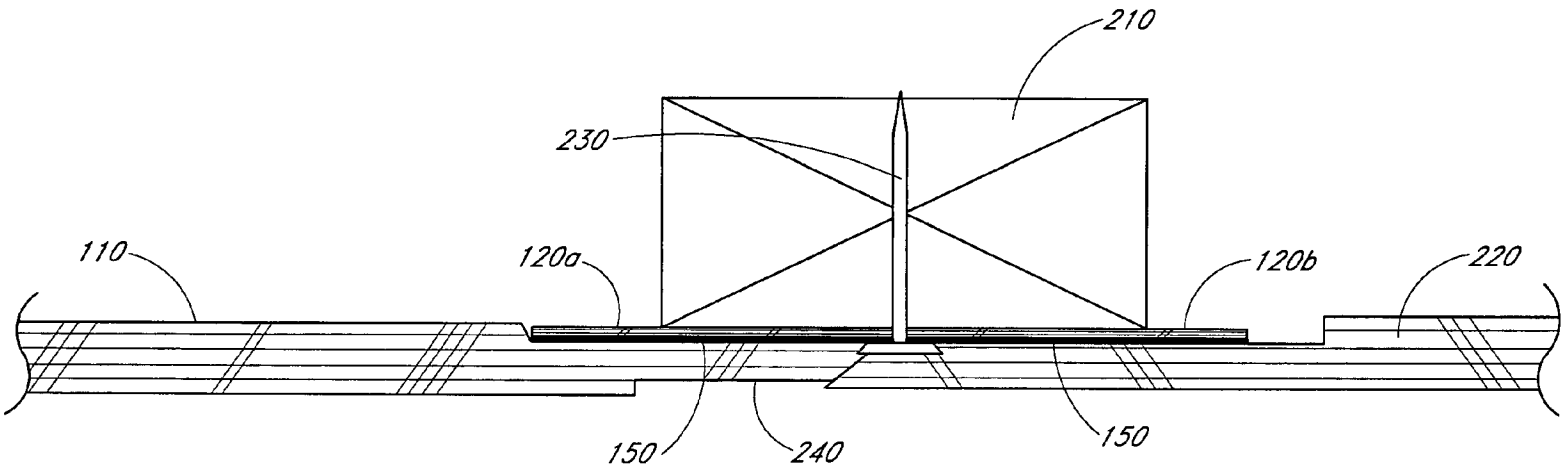
FIG. 4 shows an alternative embodiment of FIG. 3 wherein the building material is affixed to a framing element by means of a nail through the hinged connection of the flange.

As shown in FIG. 2A, the edge of the building board 110 can be further embossed or machined to provide for a recess 235 along the surface opposite the side that is connected to the joint 105. Alternatively, the recess 235 can be molded or extruded when the building board 110 is a greensheet. This recess 235 along the edge of the building board helps to form a batten 240 when the building board 110 is aligned with and connected to the building board 220 as shown in FIGS. 2B, 3, and 4. Although the batten 240 may be created by applying a recess along an edge of the building board 110, the batten is primarily ornamental and is not necessary for the functionality of the building board system.

The joint 105 is preferably co-extensive with the width of the building board 110; alternatively, the width of the joint 105 can be less than the width of the building board 110 so that multiple joints can be applied in discrete locations along the width of the building board. The flanges 120*a*, 120*b* of the joint 105 are preferably thinner than the building board 110, but may be equal or greater in thickness. The flange 120*a* is preferably wide enough to hold at least two beads of glue, but could be large enough to cover the entire back of the building board 110. The flange 120*b* is preferably wide enough to just cover the framing element width (nominal 2") and be able to hold a row of fixtures without breaking; however, the flange 120*b* could also be large enough to cover the entire back of an adjacent building board. Although the thickness of the flanges 120*a*, 120*b* depends in part on the material of the flanges, the flanges are preferably thick enough to obtain the required shear values, but not so thick as to cause unevenness on the back of the building board. The texture of the flanges 120*a*, 120*b* may also vary; however, the flanges are preferably smooth. Ideally, the texture of the flanges 120*a*, 120*b* in the illustrated embodiment aid with the bonding process between the flanges and the building boards 110, 220.

The flanges 120*a*, 120*b* of the illustrated embodiment of FIG. 2A also have capillary breaks 140 to assist with water management when water enters the joint. The hinge 130, or flexible means, may be co-extruded with the flanges 120*a*, 120*b* and may be made from a softer material than the flanges that is pliable but still holds reasonable shear strength. The hinge 130 is also preferably sized to retard water ingress when compressed against the framing element. Alternatively, the hinge 130 can be replaced by an integrated flange comprised of two separate materials, wherein the flange 120*a* is made of a softer material than the flange 120*b* and the flange 120*a* is pliable but still holds reasonable shear strength. The adhesive 150 applied to flange 120*a* and the building board 110 during manufacture can be any adhesive that has comparable shear strength with that of the joint and, optimally, has quick drying characteristics for manufacturing purposes.

Figure 13:
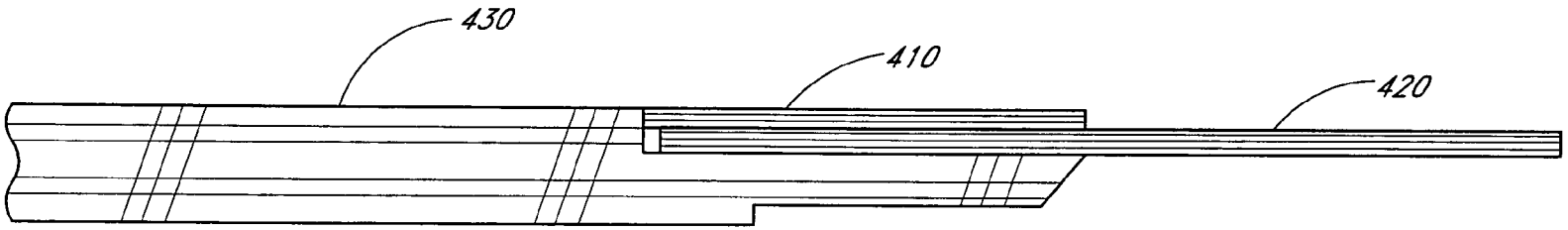
FIG. 13 is a cross sectional elevation view of one embodiment of a building material, wherein the joint is sandwiched between a strip of material and a surface of the building board such that the strip of material is flush with a surface of the building board.
Figure 14:
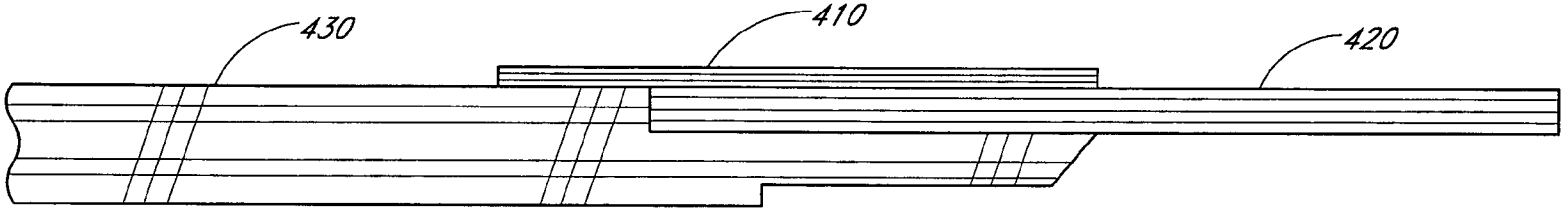
FIG. 14 is a cross sectional elevation view of one embodiment of a building material, wherein the joint is sandwiched between a strip of material and a surface of the building board such that the strip of material rests along a surface of the building board.

The flange of the joint may be attached to the building board in numerous ways. Although the preferred embodiment illustrates bonding flange 120*a* to the building board 110 by means of the adhesive 150 between the flange and a surface of the building board as shown in FIG. 2A, the flange 120*a* could be attached to the building board 110 by using a strip of material 410 to sandwich a portion of the joint 420 with an end of the building board 110 as shown in FIGS. 13 and 14. The strip of material 410 can be made of any suitable material including fibercement, plastic, and metal. The bonding between the strip of material 410 and the building board 430 may occur by various means including adhesives, structural glue, chemical bonding, mechanical bonding, pressure sensitive adhesive, and tapes.

Figure 15:
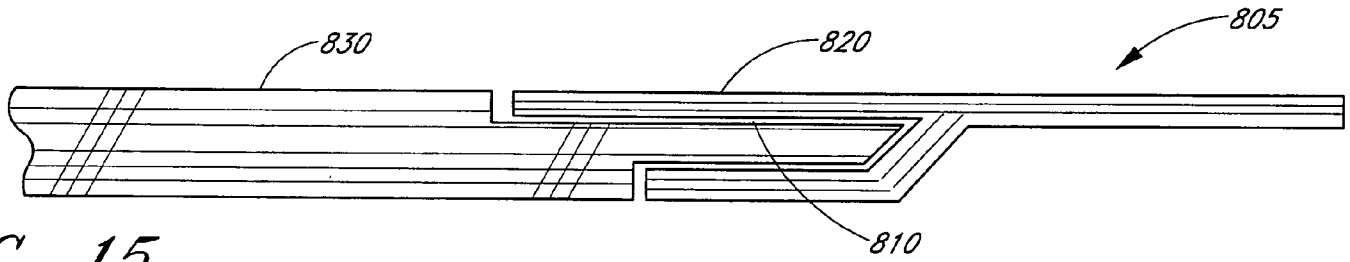
FIG. 15 is a cross sectional elevation view of one embodiment of a building material, wherein the joint has an end with a channel adapted to receive a corresponding end of the building board.
Figure 16:
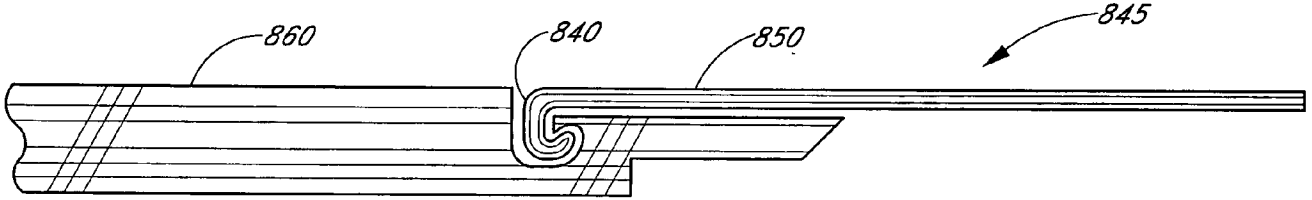
FIG. 16 is a cross sectional elevation view of one embodiment of a building material, wherein the joint has an end with a j-style hook that is adapted to snap into a lip formed along a portion of the building board.
Figure 17:
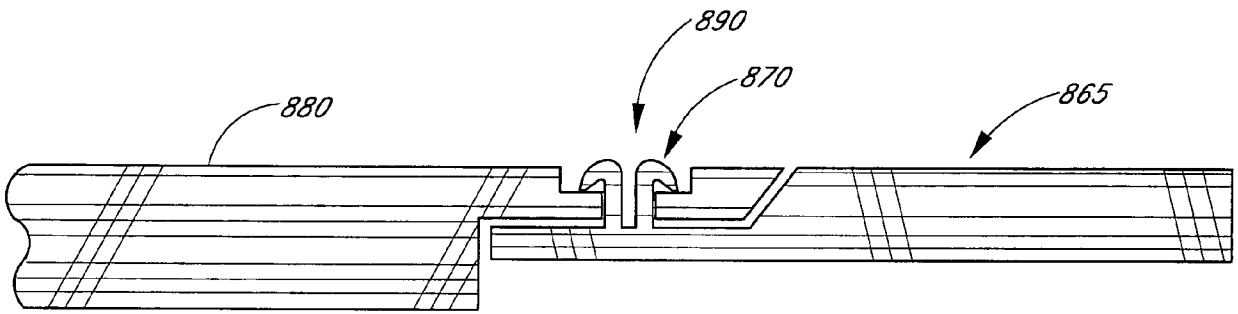
FIG. 17 is a cross sectional elevation view of one embodiment of a building material, wherein the building board has apertures adapted to receive rivet portions of a joint.

In an alternative embodiment, the joint 105 and building board 110 may be connected together by snapping the joint to an edge of the building board as shown in FIGS. 15 and 16 or by means of riveting the joint with the building board as shown in FIG. 17.

The joint 105 may be snapped into the building board 110 by various means. For instance, in one embodiment, the joint 805 can be machined or molded with a groove 810 along an edge of flange 820 that would be adapted to receive an edge of the building board 830 as shown in FIG. 15. Alternatively, in another embodiment, an end of the joint 845 can be formed with a hook 840 along the flange 850; the hook 840 being adapted to snap into an end of the building boards 860 as shown in FIG. 16.

The joint may be riveted with the building board. The joint 865 has at least one rivet portion 870 as shown in FIG. 17. The building board 880 can be molded or machined with at least one aperture 890 for receiving the rivet portion 870. The connection between the building board 880 and the joint 865 is formed by inserting the rivet portion 870 into the aperture 890 and hammering or otherwise bending the rivet portion for securing the rivet portion 870 with the building board surface.

The building material can be mounted to a wall or framing element in a number of ways. For instance, in one embodiment, the building material is an engineered panel joint 100 that can be mounted by aligning the joint 105 with the framing element 210, placing a building board 220 on the joint 105 to cover the flange 120*b*, and nailing the building board 220 and the flange 120*b* to the framing element 210 as shown in FIG. 2B. In this embodiment, the building boards 110 and 220 are affixed to the framing element 210 by a single row of nails. Although a second row of nails could be hammered through the batten 240 portion of building board 110 and the flange 120*a* to provide additional support to the building board system, a single row of nails 230 along the seam on the side opposite of the batten 240 is sufficient.

Figure 18:
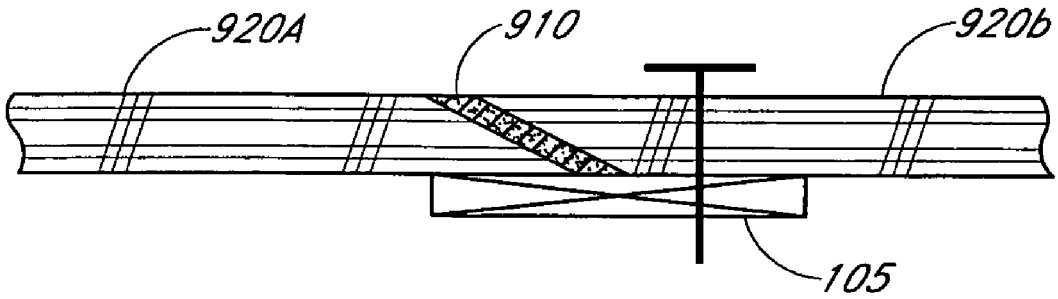
FIG. 18 is a cross sectional elevation view of one embodiment of a system of building materials, wherein an adhesive is positioned between the edges of adjacent building boards.
Figure 19:
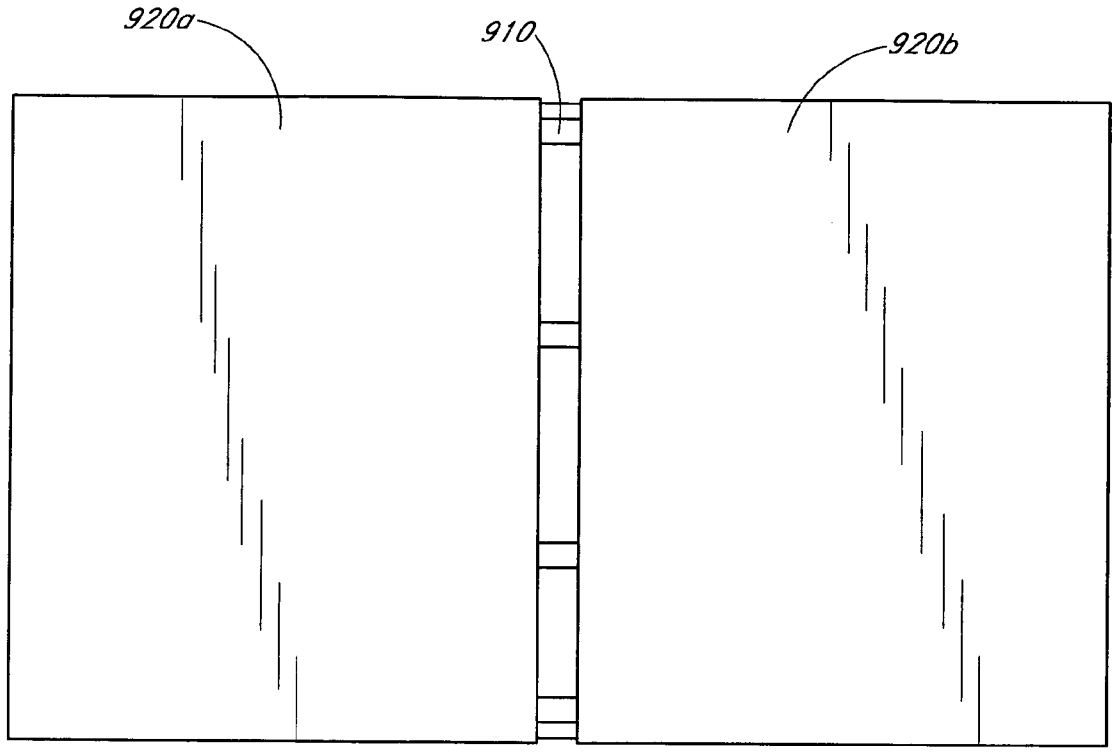
FIG. 19 is a top view of one embodiment of a system of building materials, wherein two building boards are positioned side-by-side and an adhesive is applied at discrete locations along adjacent edges of the building boards.
Figure 20:
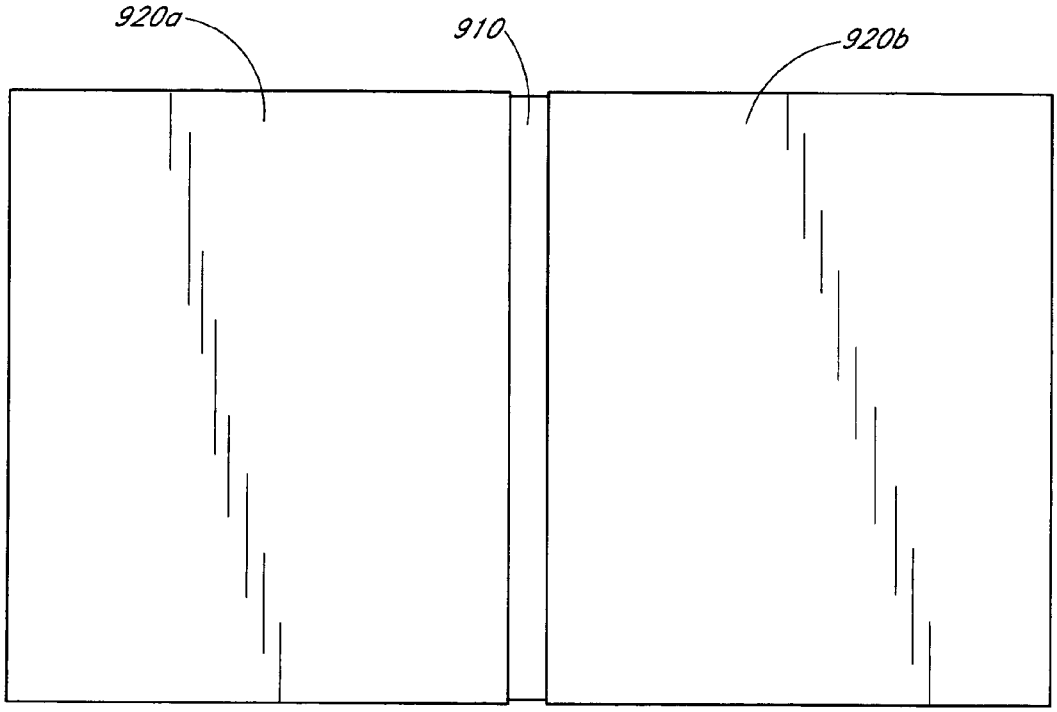
FIG. 20 is a top view of one embodiment of a system of building materials, wherein two building boards are positioned side-by-side and an adhesive is applied continuously along adjacent edges of the building boards.

An adhesive 910 may be applied between the edges of the building boards 920*a*, 920*b* as shown in FIG. 18. The adhesive 910 may be selected of any suitable adhesive material preferably sufficient to adhere fibercement together including, but not limited to, structural adhesive, polyurethane glue, hot melt polyurethane adhesive, epoxy adhesive, acrylic foam, polyurethane foam, pressure sensitive adhesive, pressure sensitive foam adhesive (e.g., butyl rubber or acrylic foam), silicone caulk and polyurethane caulk, rubber tape, and elastomeric tape with fabric backing. The adhesive 910 may be applied in one or more discrete, predetermined locations as shown in FIG. 19 or continuously along the edge of adjacent panels 920*a*, 920*b* as shown in FIG. 20. Although the system of building boards is preferably connected together to structural framing elements 210 by the joint 105, application of the adhesive 910 between the edges of adjacent building boards 920*a*, 920*b* will provide the system with sufficient shear strength without the joint 105. The adhesive 910 will not only assist in causing to connect adjacent building boards 920*a*, 920*b* together but increase the shear strength capacity of the assembly, restrict relative movement between building boards and out of plane movement, and increase load transfer between building boards.

The increased shear strength capacity of a system of building materials with an adhesive between the edges of adjacent building boards is exemplified by results of ASTM E72-02 Section 14 tests of such a system. For instance, where the adhesive is discontinuously applied between the edges of the boards, the system is able to withstand a load of more than 220 pounds per foot using a 6"×12" nailing pattern. Where the adhesive is continuously applied between the edges of the boards, the system is able to withstand a load of more than 260 pounds per foot using a 6"×12" nailing pattern.

Although the embodiment of FIG. 2B provides for an adhesive only between the flange 120*a* and the building board 110, the adhesive 150 may also be applied between the flange 120*b* and the building board 220 as shown in FIGS. 3 and 4. The adhesive 150 is preferably a hot melt polyurethane, such as Loctite Hysol 3631 hot-melt polyurethane adhesive, however, the adhesive could be any suitable adhesive including, but not limited to, structural glue, such as a Bostik ISR 7003 polyurethane glue or in the form of a pressure sensitive adhesive tape, such as 3M VHB 4956 Pressure Sensitive Foam tape or PVT-3300 Butyl Rubber Taype (Calisle Coating & Waterproofing Inc). The adhesive 150 may be applied continuous or discretely along the length of the flange 120*b*. For instance, a pressure sensitive adhesive tape may be applied to the flange 120*b* at the factory; the tape having a peel away top material to protect the adhesive tape. The peel away top material can be removed in the field to expose the pressure sensitive adhesive prior to adhering the flange 120*b* to the building board 220. This method of installation has the added advantage of creating a "blind nail" in which the nail is hidden behind the building board 220 as opposed to the embodiment of FIG. 2B wherein the single row of nails 230 are in view.

Figure 21:
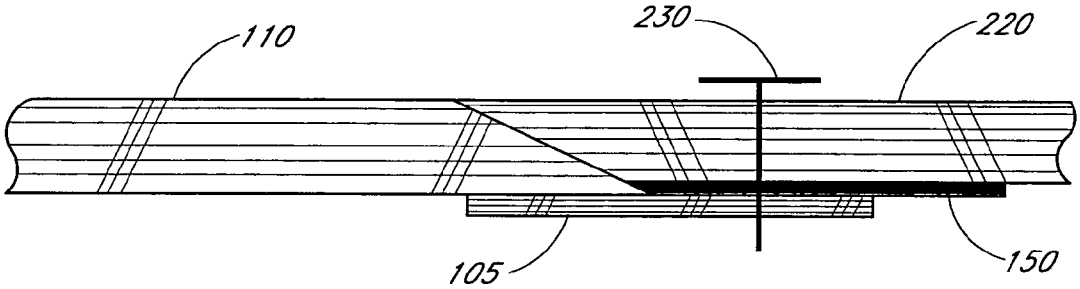
FIG. 21 is a cross sectional elevation view of one embodiment of a system of building materials, wherein an adhesive is positioned between the nailing region of the joint and a surface of an adjacent building board.

The engineered panel joint 100 may, alternatively, be fixed to a framing element 210 by aligning the joint 105 to the framing element 210 and nailing the flange 120*b* to the framing element as shown in FIG. 21. In this alternative embodiment, the building board 110 is preferably secured to the framing element by a single row of nails 230 in a similar manner as described in connection with the embodiment of FIG. 2B. However, while the embodiment of FIG. 2B provides for an adhesive only between the flange 120*a* and the building board 110, the embodiment of FIG. 21 further provides for an adhesive, such as structural glue, or self adhesive tape, such as pressure sensitive adhesive tape, applied between the flange 120*b* and an end of the building board 220. The adhesive between flange 120*b* and the building board 220 will help to restrict relative movement, out of plane movement and increase load transfer between panels. In addition, the adhesive 150 and/or pressure sensitive adhesive tape will help to increase the shear strength capacity of the building board system or assembly.

In yet another embodiment, the engineered panel joint 100 may be affixed to the framing element 210 by placing a single row of nails 230 through the hinge 130 of the joint 105 as shown in FIG. 4. In this embodiment, the building board 110 is installed by aligning the building board 110 on the framing element 210 to place the hinge 130 near the center of the framing element 210, and then hammering or fastening a row of nails along and through the length of the hinge 130. The building board 220 is attached to the framing element 210 and the building board 110 by means of the adhesive 150, or a self adhesive tape, as shown in FIG. 4. The adhesive 150 is applied to either the flange 120*b* or the edge of the building board 220. As with the embodiment of FIG. 3, this method of installation has the advantage of creating a "blind nail" in which the nail is hidden behind the building board 220 as opposed to the embodiment of FIG. 2B wherein the single row of nails 230 are in view.

Figure 22:
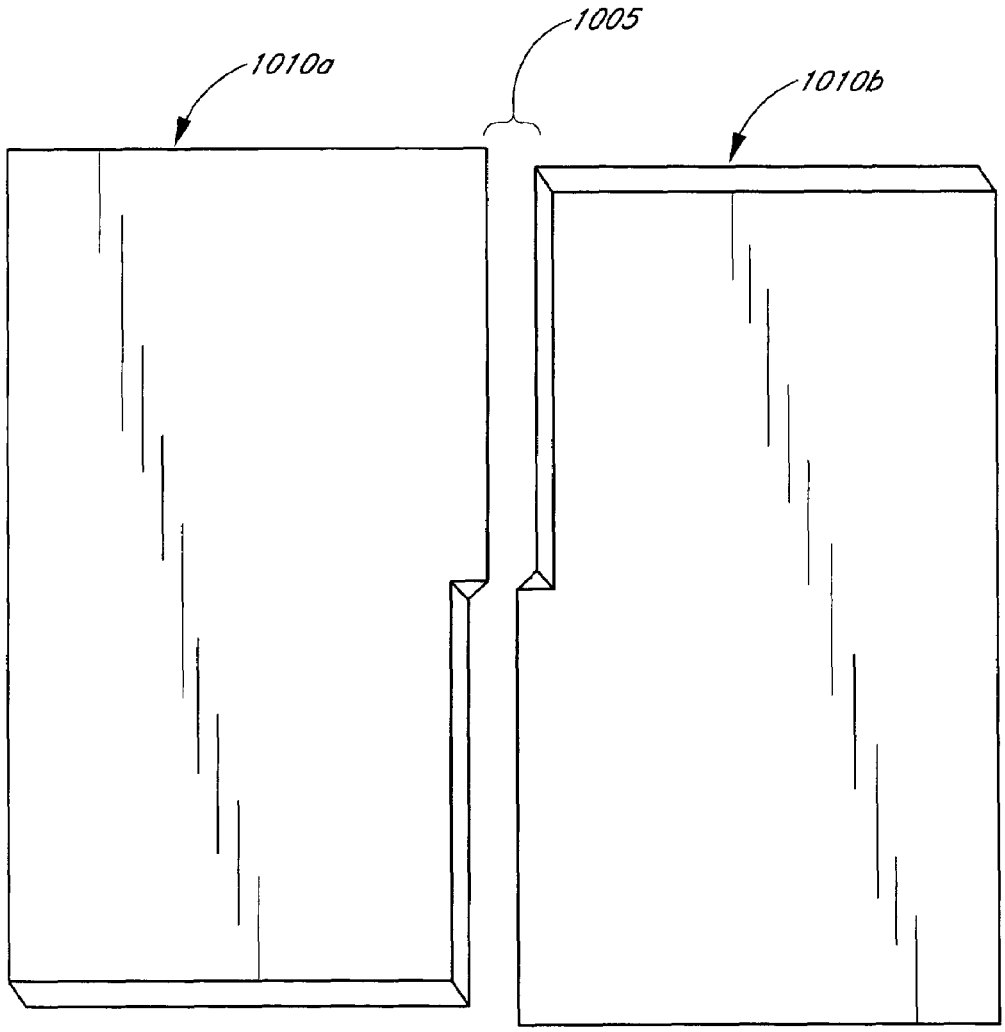
FIG. 22 is a top view of one embodiment of a system of building materials, wherein two building boards have corresponding beveled edges adapted to mate together to form an interlock.
Figure 23:
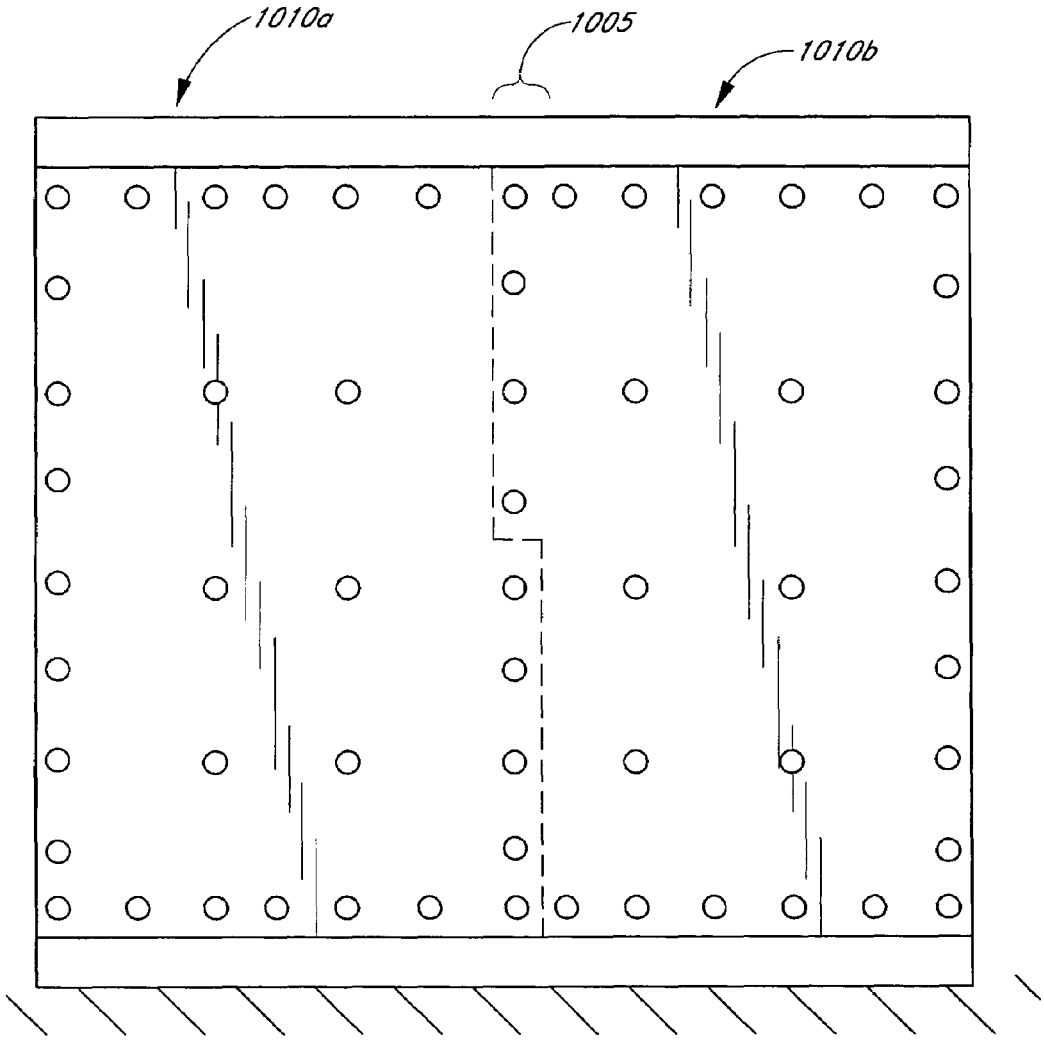
FIG. 23 is a top view of the building boards of FIG. 22 interlocked together.
Figure 24:
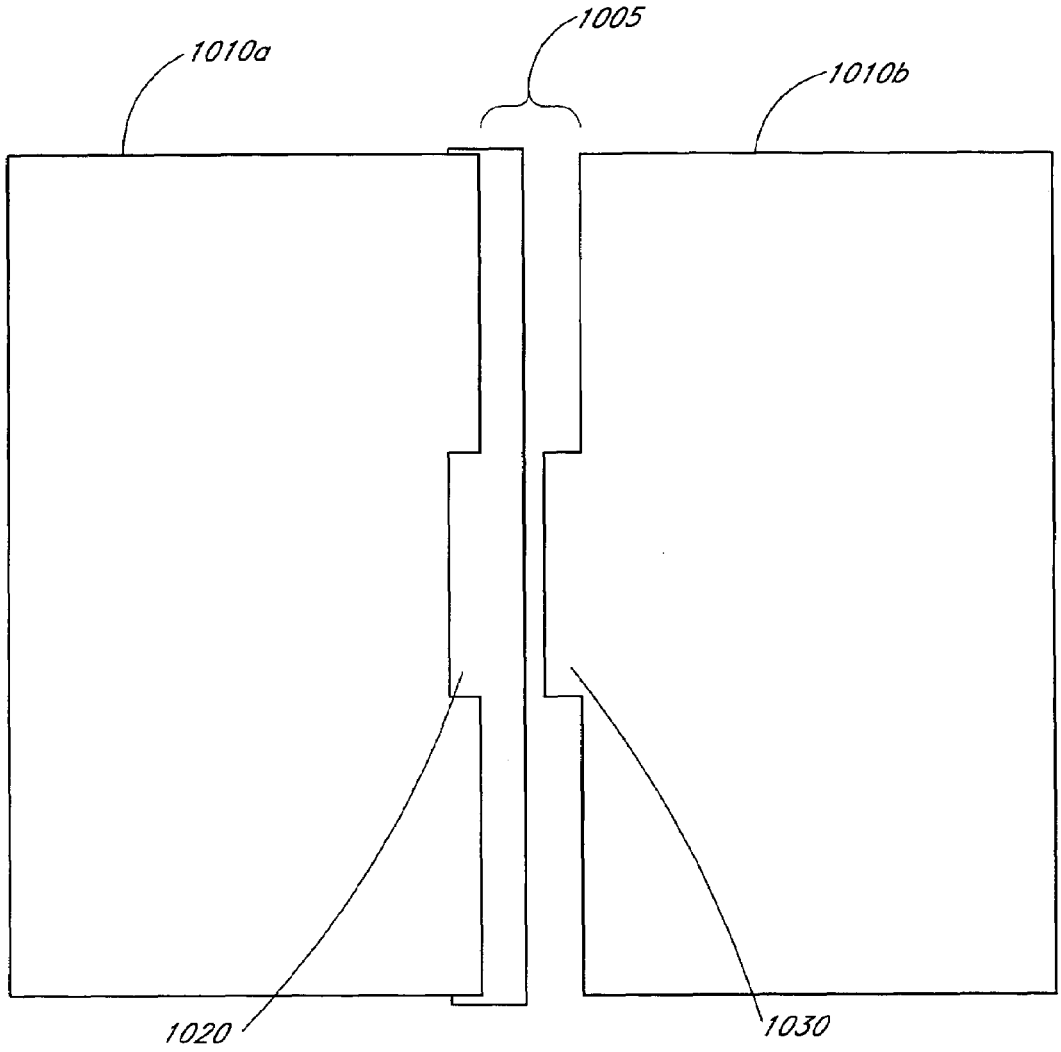
FIG. 24 is a top view of one embodiment of a system of building materials, wherein one board has a notch and the other board has a corresponding tab adapted to mate with the notch.
Figure 25:
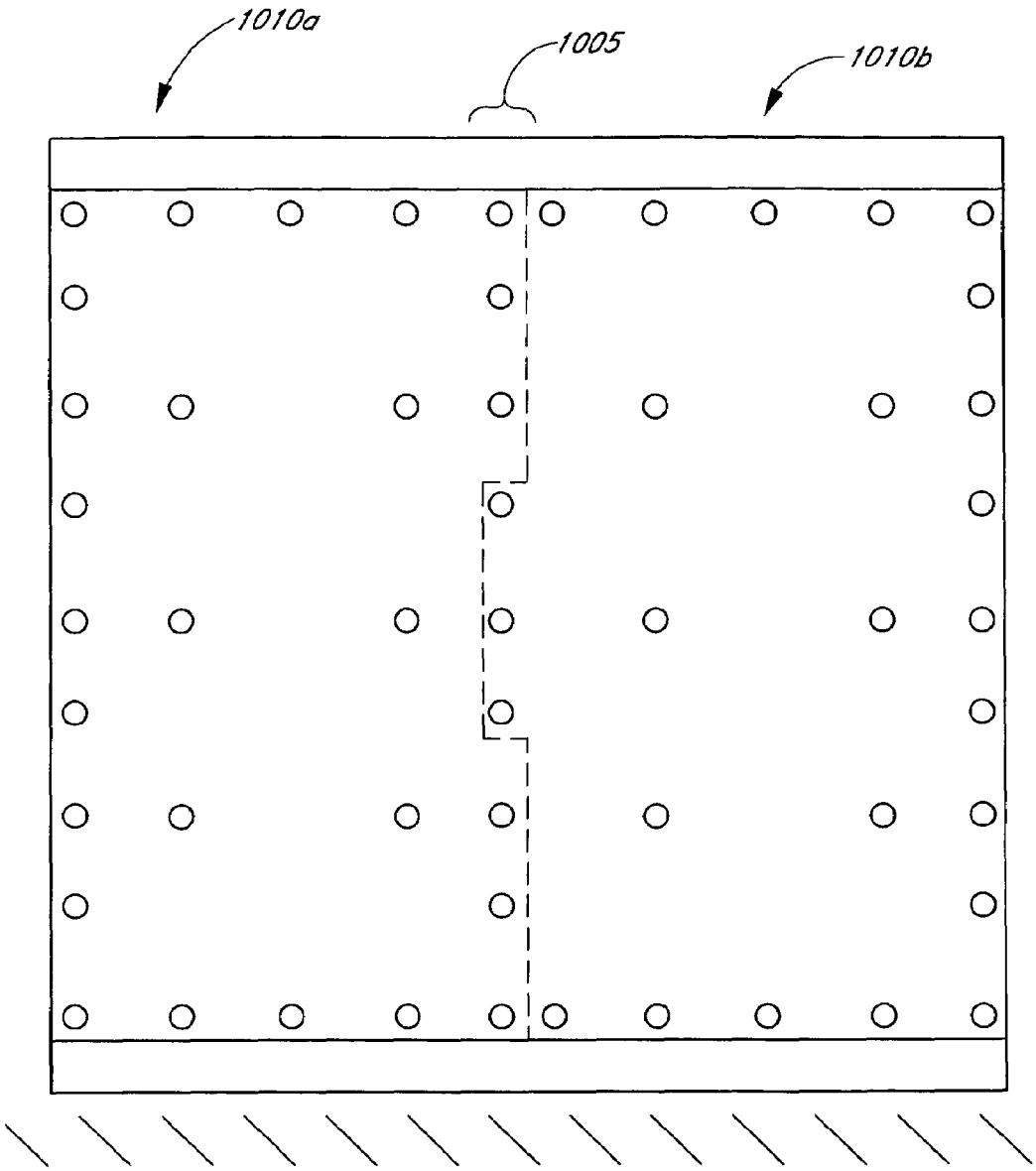
FIG. 25 is a top view the building boards of FIG. 24 interlocked together.

To enhance load transfers across the joint and allow the assembly or system of building boards to act in unison as one large building board, the edges of the boards may be beveled at a suitable angle to create an interlock 1005 between adjacent building boards 1010*a*, 1010*b* as shown in FIGS. 22-25. The angle of the bevel is preferably between 30 and 60 degrees as shown in FIG. 22. The interlock 1005 is preferably formed by a change in bevel angles along an edge of building boards 1010*a*, 1010*b*. Although FIGS. 22 and 23 show a change in the bevel angle near the approximate center of the building boards 1010*a*, 1010*b*, the change in angle could be fabricated at any point along the edge of the building board. In an alternative embodiment, the interlock 1005 is formed by creating at least one notch 1020 along the edge of the building board 1010*a* for receiving at least one tab 1030 adapted to fit within the notch 1020 as shown in FIGS. 24 and 25. The notch 1020 and corresponding tab 1030 are preferably located near the center of building boards 1010*a*, 1010*b* and has a length of approximately one foot, but the length can be any suitable measure capable of resisting shear loads. In alternative embodiments, the notch 1020 and corresponding tab 1030 may be positioned at multiple locations along an edge of the building boards 1010*a*, 1010*b* and spaced predetermined intervals along that edge.

The interlocks may be formed by using a water jet to cut the beveled angles or the notches and tabs along the ends of the building boards. The interlocks may also be formed when the building board is a greensheet or post autoclave on the finishing line. The resulting interlock will help to resist higher shear loads when adjacent building boards with the beveled angles and/or notches and tabs are connected together.

The increased shear strength capacity of a system of building materials having an interlock between adjacent building boards is exemplified by results of ASTM E72-02 tests on such a system. Based on such tests using a 6"×12" nailing pattern, the system of building materials having an interlocking feature is able to withstand a load of 200 pounds per foot or more. For instance, a test of one embodiment having a structure substantially similar to the system of FIG. 25, wherein the building board had a thickness of approximately ⅜ of an inch, the system was able to withstand a load of approximately 216 pounds per foot. In a test of another embodiment having a structure substantially similar to the system of FIG. 23, wherein the building board had a thickness of approximately ⅜, the system was able to withstand a load of over 250 pounds per foot.

As mentioned earlier, the building boards can be made from a number of different materials including, but not limited to, the grade and/or thickness of fibercement. However, regardless of the material or the dimensions of that material, a building board having the joint, discussed and provided for in the above description, is able to perform with sufficient shear strength, satisfying building codes, with a single row of nails along the joint connecting two building boards.

Figure 7A:
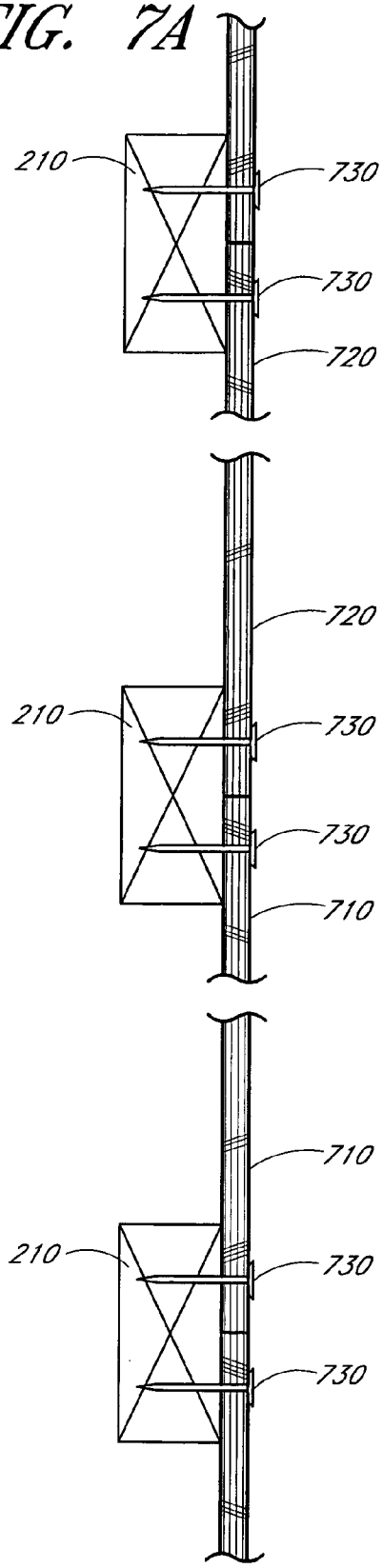
FIG. 7A is a cross sectional elevation view of a system of panels connected to a structure based on how panels are typically installed wherein the joints between panels require two rows of nails at each framing element.

For instance, the industry standard uses two rows of nails on a panel without the joint 105. A system of panels, as shown in FIG. 7A, is attached to the exterior of a structure by aligning a panel 720 between two framing elements 210 so that two of the panel edges slightly cover each framing element. A row of nails 730 is then hammered or fastened through each panel edge to secure the panel 720 to the framing elements. Once this panel 720 is secured to both framing elements, another panel 710 is placed next to the secured panel and between another set of framing elements 210. This panel 710 is then secured to the framing elements 210 by hammering or fastening a row of nails 730 along each panel edge. This process is repeated until the exterior of the structure is covered with panels.

This typical process of securing panels requires the use of two rows of nails on each panel (e.g., one row of nails along opposite ends of each panel) and two rows of nails at a single framing element where the two panels meet. As one can quickly recognize, this process can be costly and inefficient. However, because of the available materials and products in the building industry, it is the industry standard to use two rows of nails at each joint or framing element to achieve the necessary joint and shear strength to meet building codes.

Figure 7B:
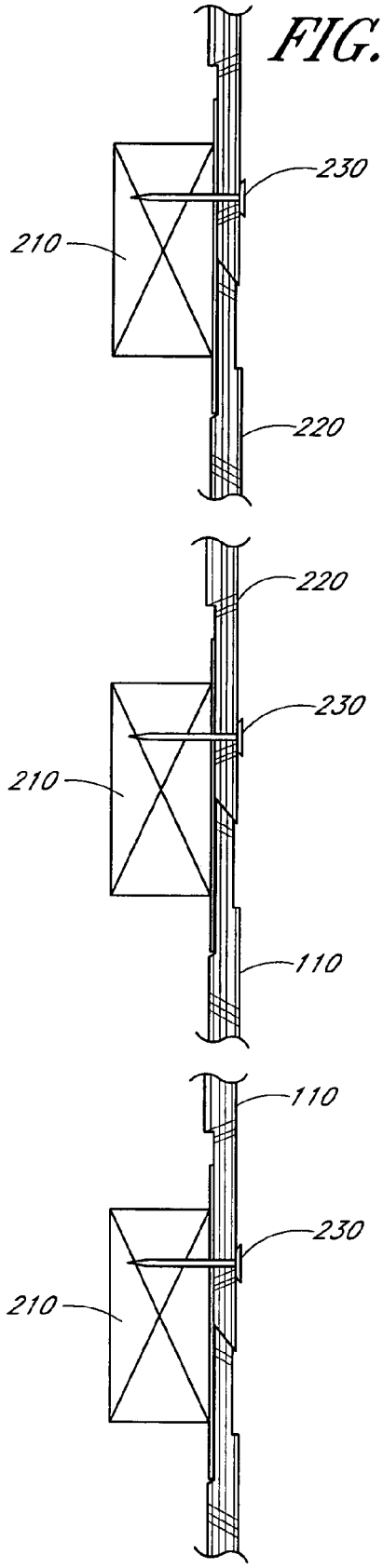
FIG. 7B is a cross sectional elevation view of one embodiment of a system of building materials, wherein the panels are connected to a structure requiring only a single row of nails at each joint or framing element.

In a test conducted according to the ASTM E72-02 Section 14 standard using a 6"×12" nailing pattern, a system of engineered panel joints were nailed to framing elements using a single row of commercially available 8d nails, as shown in FIG. 7B, and then were subjected to a load. A similar test was conducted on a system of industry standard panels without the joint 105 but using two rows of commercially available 8d nails, as shown in FIG. 7A. The results of those tests, as summarized in Table 1, show that the engineered panel joints have better deflection values and a better ability to withstand an ultimate load of 200 pounds per foot than the industry standard.

TABLE 1

Results of ASTM E72-02 Section 14 Test Comparing the Shear Strength of the Engineered Panel Joint Using a Single Row of Nails with that of the Industry Standard Using Two Rows of Nails

| | Panel Grade | Row(s) of Nails | Normal Panel Thickness (inches) | Shear Value (lbs/ft) ⅛" deflection | Shear Value (lbs/ft) Ultimate Load |
|---|---|---|---|---|---|
| Engineered Panel Joint | Fiber-cement | 1 | 5/16 | 200 | 222 |
| | Modified density fiber-cement | 1 | ⅜ | 233 | 200 |
| Industry Standard-panel w/o joint | Plywood (industry std.) | 2 | ⅜ | 150 | 208 |

Systems of building materials employing embodiments of the invention, secured to a structure using a 6"×12" nailing pattern, will be able to withstand shear values between 130 lbs/ft and 270 lbs/ft in an ASTM E72-02 section 14 test; however, such systems preferably have a minimum shear strength of 150 lbs/ft.

A system of building materials using embodiments of the invention that employ higher nailing patterns will be able to achieve even higher shear strengths. For example, a system of building materials using embodiments of the invention, secured to a structure using a 4"×6" nailing pattern, could have achieve shear strengths greater than 300 lbs/ft. As exhibited in Table 2, the minimum shear strength values of the system of building materials employing embodiments of the invention will, in general, increase as the nailing pattern increases (e.g., as the nail spacing perimeter decreases, the minimum shear strength values of the system increase).

TABLE 2

Minimum Shear Values of Building Materials Employing Embodiments of the Invention.

| Nail Spacing Perimeter | Nail Spacing in Field (on framing element) | Value (lb/ft) ⅛" deflection | Value (lb/ft) Ultimate load |
|---|---|---|---|
| 6" | 12" | 150 | 208 |
| 6" | 6" | 162 | 212 |
| 4" | 6" | 175 | 308 |
| 3" | 6' | 191 | 397 |
| 2" | 6" | 178 | 488 |

Figure 26:
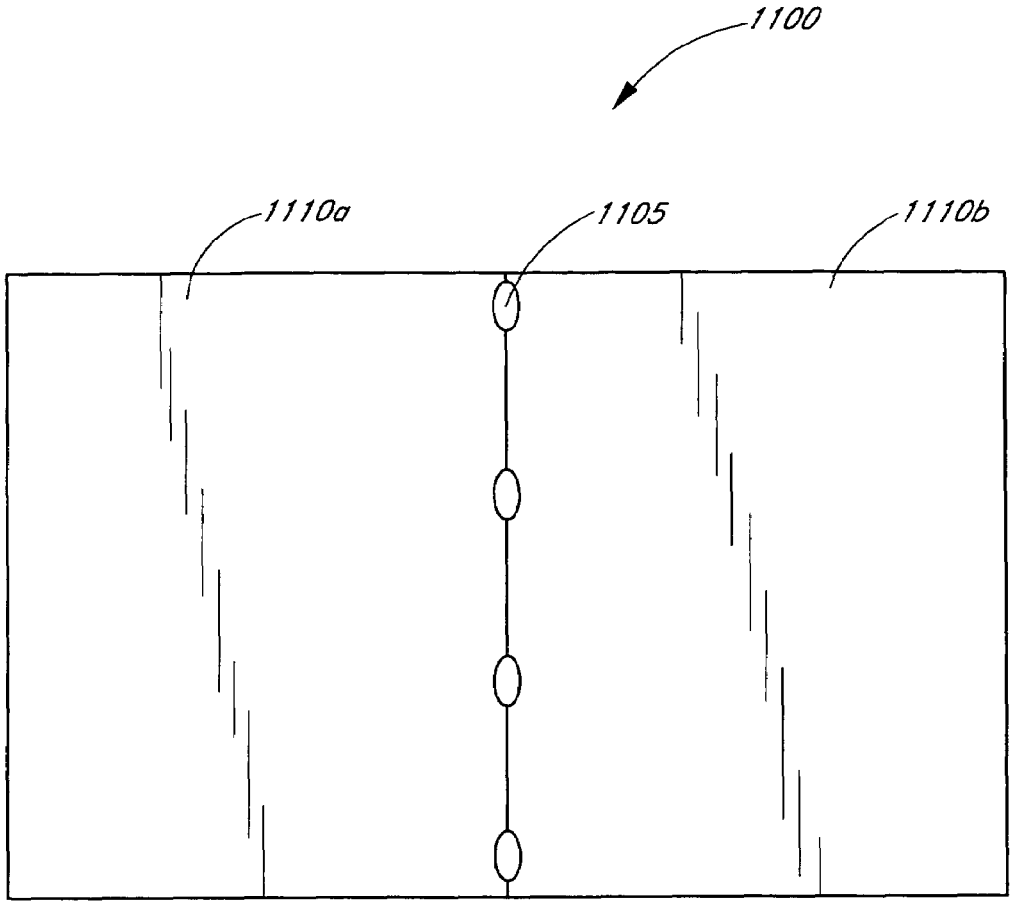
FIG. 26 is a top view of one embodiment of a system of building materials, wherein two building boards are connected together and biscuits are slotted along the adjacent edges of the building boards.

To provide additional shear strength to the panel system, at least one biscuit 1105 may be inserted along the edge of the panel 1110*a* for receipt in a corresponding slot along the edge of an adjacent panel 1110*b* as shown in FIG. 26. Although FIG. 26 shows a panel system 1100 without the joint 105, the biscuits 1105 may be used in conjunction with the joint to increase the shear strength of a system of the engineered panel joints 100. The slots may be formed along the edge of the panels 1110*a*, 1110*b* by a jointer router. Prior to connecting two adjacent panels 1110*a*, 1110*b* together, the biscuits 1105 may be inserted in the slots of at least one of the panels. The biscuits 1105 may be connected to the panels 1110*a*, 1110*b* by any suitable fastener including chemical bonding, mechanical bonding and adhesives. Although the biscuit 1105 shown in FIG. 26 is preferably made from pressed wood particles, the biscuits can be made of any suitable material including metal, fibercement, and plastic.

The increased shear strength capacity of a system of building materials with biscuits between the ends of adjacent building boards is exemplified by results of ASTM E72-02 Section 14 tests on such a system. Based on such tests using a 6"×12" nailing pattern, the system is able to withstand a load of at least 170 pounds per foot and deflect ⅛ inch under a load of approximately 230 pounds per foot or more. For instance, in a test of one embodiment having a structure substantially similar to the system shown in FIG. 26, wherein the building boards had a thickness of approximately ⅜ of an inch, the system had a shear strength greater than 150 pounds per foot.

In addition to attaching the joint 105 to a panel, as mentioned above, the engineered panel joint 100, with or without the biscuit 1105, can be formed from other building boards, including planks, roofing shakes, slates, and tiles. For instance, the joint 105 could be applied to a trim 1200 as shown in FIGS. 27-29.

Figure 27:
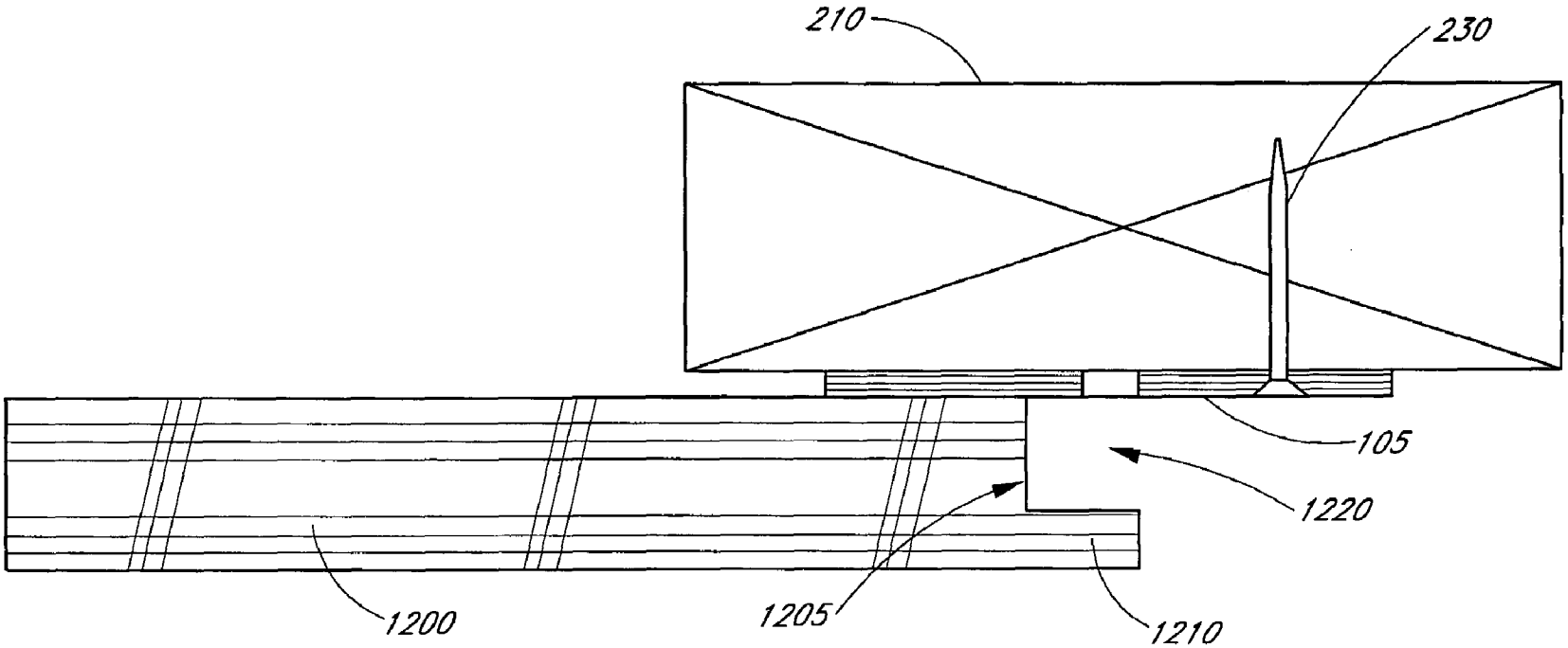
FIG. 27 is a cross-sectional elevation view of one embodiment of a building material, wherein a portion of the joint is extending from an edge of a flat plank trim.
Figure 28:
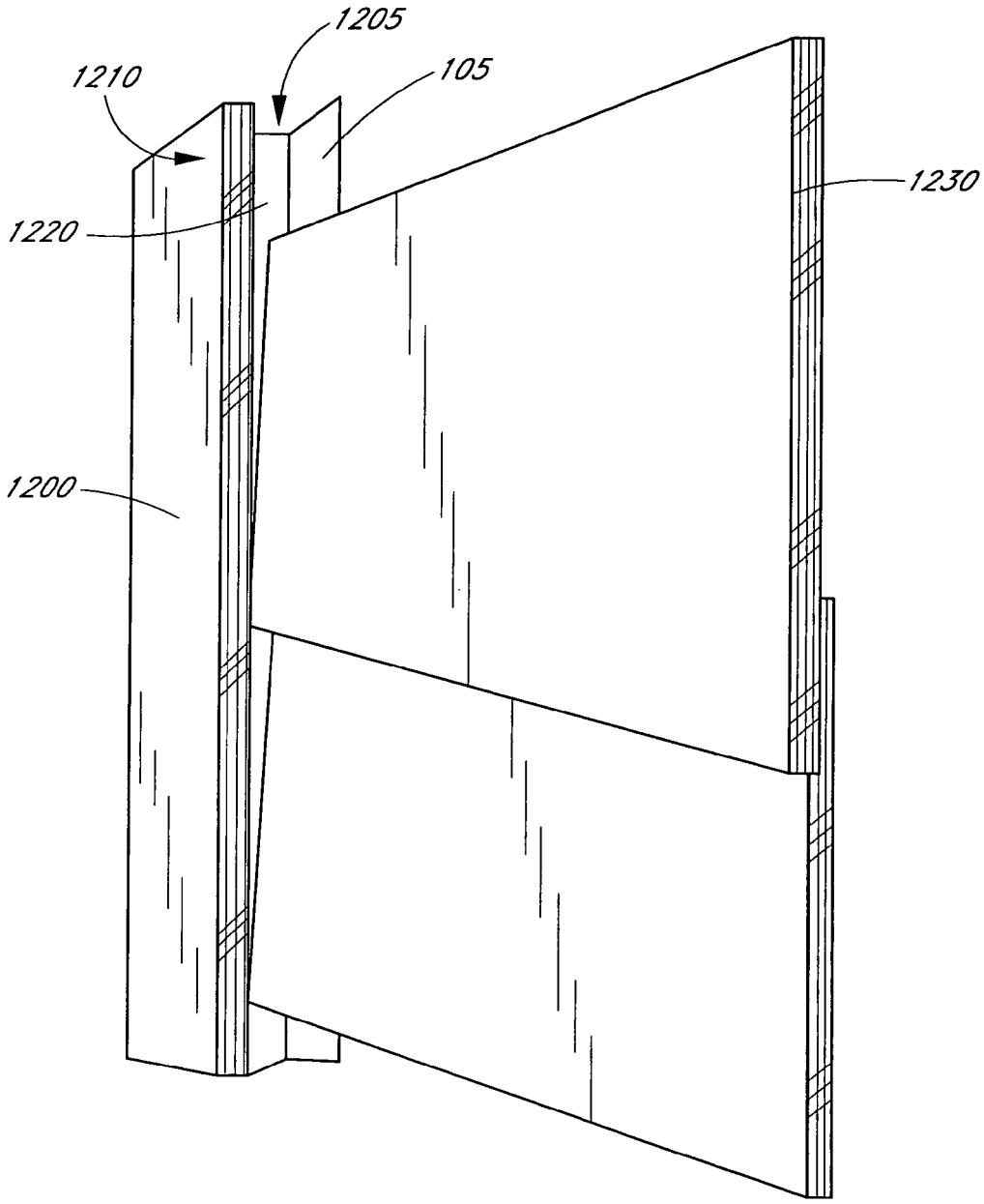
FIG. 28 is perspective view of the building material of FIG. 27, wherein siding planks are connected to the trim.
Figure 29:
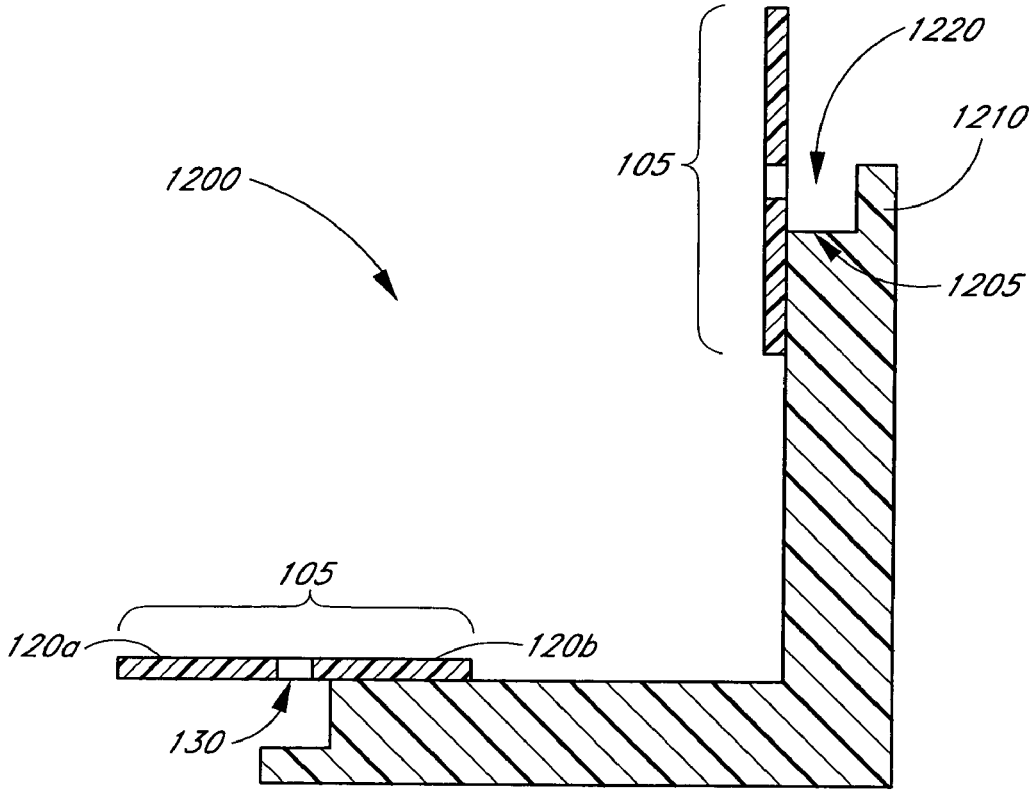
FIG. 29 is cross-sectional elevation view of one embodiment of a building material, wherein a portion of the joint is extending from an edge of a corner trim.

The trim 1200 of FIGS. 27-29 is preferably made of a low density fibercement material; however, it could be made of a number of other materials including, but not limited to, wood, metal, and plastic. Trim 1200 may also be made of a non-nailable material, including but not limited to, stone, ceramic or metal. The trim 1200 may also have a factory applied finish or a finish applied in the field prior to installation.

The trim 1200 of FIG. 27 is shown as a flat plank; however, the trim assembly could be applied to corner pieces (as illustrated in FIG. 29) or planks adapted to be placed in any number of positions including around windows and doorways. Also, the corner trim 1200 can be assembled from separately formed flat pieces or extruded or molded to form, for example, the corner shape shown in FIG. 29. The trim 1200 may be extruded or molded into any type of arcuate or angled shape. Trim 1200 may also be assembled or formed from a combination of arcuate, angles or flat shapes to provide decorative trim articles suitable for use on or around windows, doors, entryways, gable vents, porticos, pilasters, shutters and the like.

The trim 1200 preferably has an edge 1205 with an extending flange 1210 along the front surface of the trim. The edge 1205 is preferably machined or extruded such that it can accommodate siding planks. The joint 105 is preferably attached to the back surface of the trim 1200 such that a portion of the joint 105 extends from the edge 1205 forming a channel 1220 with the edge 1205 and the flange 1210; the channel 1220 adapted to receive a siding plank. The joint 105 may be attached to the trim 1200 by any suitable means including chemical bonding, mechanical bonding, and adhesives.

As shown in FIG. 27, a portion of the joint 105 may serve as a nailing hem, wherein the trim 1200 is attached to a framing element by at least one fastener 230 through the joint 105 into a framing element 210. Using the joint 105 as a nailing hem offers the advantage of hidden nailing. As shown in FIG. 28, one or more siding panels 1230 may be inserted edgewise into channel 1220 such that the edge of siding panel 1230 is butted against trim edge 1205 and contained within channel 1220. In this assembly the joint 105 also acts as a flashing to prevent water ingress behind the siding panel 1230. Thus, the assembly does not require caulking and therefore reduces installation time and cost. Also, the surface of siding planks 1230 cause to cover the joint 105 and hide the row of nails when the siding planks are slotted into the channel 1220 between the flange 1210 and the joint.

The joint can be made of a number of different materials, including a variety of meshes, such as metal, fiberglass, and fabric. Where the joint is formed of two flanges, such as the joint 105 of FIG. 2A, the joint preferably has a flexible hinge 130 and can function as flashing. The flexible hinge 130 can be made of a plastic material that assists with reducing water ingress. Alternatively, a plastic bead can be added between the joint 105 and the back surface of the trim 1200 to reduce water ingress.

Figure 5:
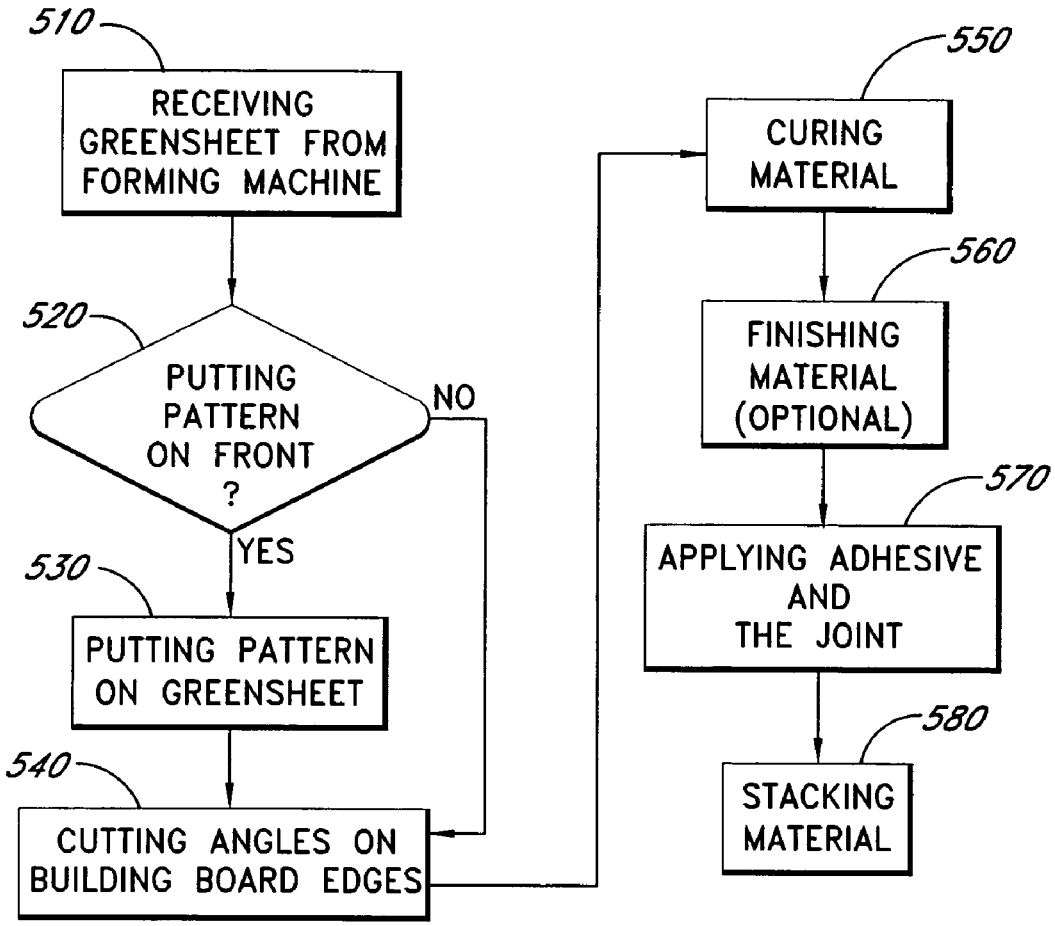
FIG. 5 is a flow chart illustrating a preferred method of manufacturing the building material of FIG. 2A using a fibercement building board.

A preferred method of manufacturing the engineered panel joint 100 from a fibercement building board involves the following steps as shown in FIG. 5. The method which is described and illustrated herein is not limited to the sequence of acts described, nor is it necessarily limited to the practice of all of the acts set forth. Other sequences or acts, or less than all of the acts, or simultaneous occurrence of the acts, may be utilized in practicing embodiments of the invention. Furthermore, as mentioned earlier, although the preferred material for building board is fibercement, the building board can be made from a variety of materials, such as wood or steel.

Step 510: Receiving greensheet from forming machine: In this step, a moldable fibercement "greensheet" is produced by a forming machine. This forming machine uses a slurry dewatering manufacturing process, such as, but not limited to, the Hatschek process. Once the moldable fibercement greensheet is formed, it is feed through to the rest of the process.

Step 520: Putting pattern on front: In this step, a decision is made concerning whether to add a pattern or texture to the fibercement greensheet to provide for an ornamental feature on the building board. If it is determined that an ornamental feature is desired, the manufacturing process will proceed with step 530; if it is not desired, the manufacturing process will skip step 530 and proceed to step 540.

Step 530: Putting a pattern on the greensheet: In this step, a pattern is applied to the fibercement greensheet. This pattern is preferably applied to the greensheet by a means of embossing or pressing using a roll or a plate, but can be also be applied by a variety of other methods including, but not limited to, craving, beveling, or jet spraying. A texture or batten is preferably applied to the front of the building board while on the back, a recessed channel is preferably created in which the joint will rest and become flush with the building board, adding no appreciable thickness to the engineered panel joint. Preferably, the battens are embossed or pressed into the greensheet after the texture is applied embossed or pressed.

Step 540: Cutting angles on building board edges: In this step, 30° angles are preferably cut from the top and bottom vertical edges of the building boards by a water jet. Angles other than 30° may be used within the range of 90° to 180°. Alternatively, the edges may have a combination of angles or compound angels as illustrated in FIG. 8. In addition, these angles can be cut by a means other than using a water jet, such as by using saws or by roll forming.

Step 550: Curing material: In this step, the fibercement greensheet is preferably pre-cured at an ambient temperature for a period of up to 24 hours. The greensheet is then preferably placed in an autoclave for a period of up to 12 hours at a temperature of approximately 180° C. and a pressure of approximately 125 psi. Alternatively, the fibercement greensheet may be air cured or moisture cured under relatively humid conditions at an ambient or elevated temperature until a predetermined level of strength and/or a preselected material property is obtained. For example bending strength or tensile strength is may be selected, but other material properties such as density, shear strength, moisture content or content of unreacted components may also be used as an index of degree of cure.

Step 560: Finishing material (Optional): In this step, a coating is optionally applied to at least one side of the building board preferably by a spray coating apparatus, but could be applied by other means including, but not limited to, roll coating, curtain coating, powder coating, vacuum coating, or other known means of coating. The coating is then cured in a manner appropriate to the coating formulation, for example by thermal curing, radiation curing, or a combination thereof.

Step 570: Applying adhesive and the joint: In this step, the adhesive and the joints are applied to the back side of the building board as the building board moves along rolling conveyors. The adhesive is preferably a hot melt polyurethane glue, but can be made from any composition that provides a good bond and adequate shear strength between polymers and cementitious surfaces. The joints may be made from a variety of materials, including fibercement, but is preferably made from a plastic material, such as PVC. The joints may be pre-cut as strips before they are applied to the building board or may be applied directly from a spool. Accordingly, there are alternate ways by which the adhesive and joints can be applied to the building board. For instance, the adhesive can be applied to the surface of the joint strips before the building board and joint strips are pressed together. Alternatively, the adhesive may be preformed on the joint strips in a liquid form or as a self-adhesive strip. The self-adhesive strip could be either attached to the building board during the manufacturing process or in the field during the installation process. In another embodiment, the building boards are flipped over after step 560 so that the backside of the building boards face up. The adhesive and joint strips are then applied to the backside of the building boards along the edge to form the engineered panel joint. The building boards are then flipped back over so that the front side faces up. In yet another embodiment, the joint strips are attached using various other fastener types such as, but not limited to, screws, staples, or other adhesive means. In a separate embodiment, the joints are installed onto greensheets after step 540. In another embodiment, the joint strips are sized to fit along the entire back surface of the building board. The joint strips are attached to cover most of the backside of the building board, but are offset from the building board such that the joint strip extends beyond the building board along one edge for joining the building boards.

Step 580: Stacking material: In this step, the finished engineered building material is stacked for packaging and/or shipping.

Figure 6:
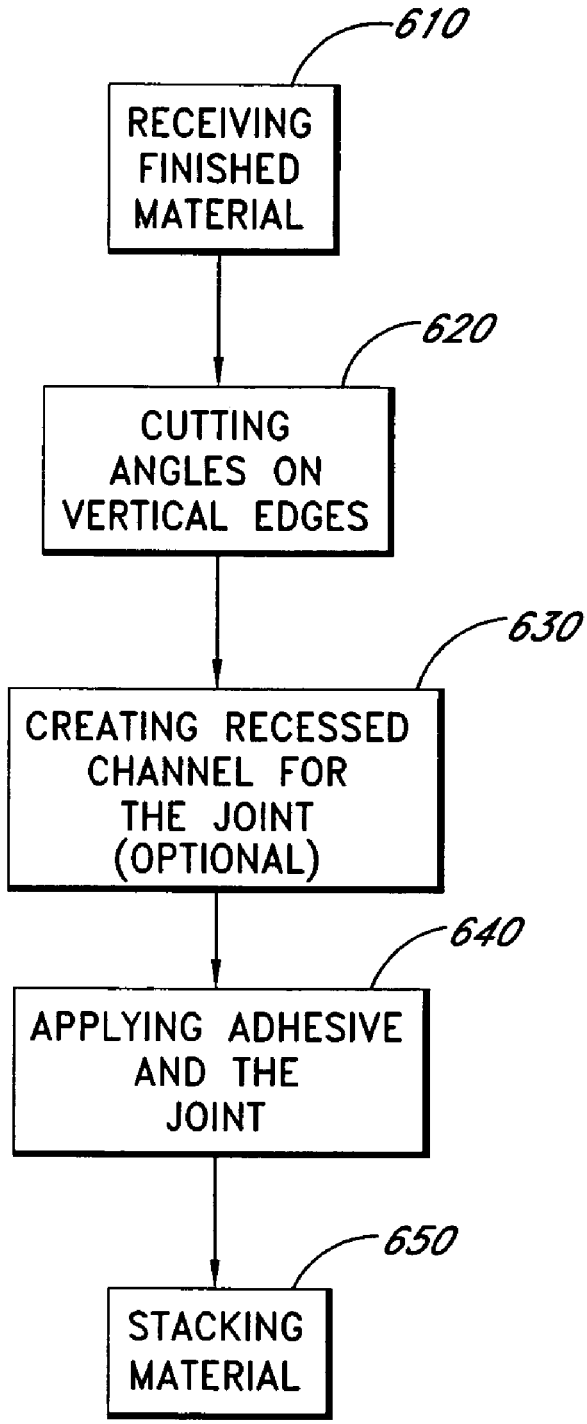
FIG. 6 is a flow chart illustrating an alternative method of manufacturing the building material of FIG. 2A using building boards made from materials other than fibercement.

As mentioned above, one preferred embodiment of the engineered panel joint is manufactured from a fibercement building board. Other materials, however, may be substituted for the fibercement building board. If an alternative building board material is used, the following method of manufacturing the engineered panel joint, as shown in FIG. 6, is preferred. However, the method which is described and illustrated is not limited to the sequence of acts described nor is it necessarily limited to the practice of all of the acts set forth. Other sequences or acts, or less than all of the acts, or simultaneous occurrence of the acts may be utilized in practicing embodiments of the invention.

Step 610: Receiving finished material: In this step, any building board material, such as, but not limited to, wood, wood composites, and vinyl is obtained in a finished state or finished according to methods known to a person of ordinary skill in the art.

Step 620: Cutting angles on vertical edges: In this step, angles within the range of 30° and 60° are preferably cut from the top and bottom vertical edges of the building boards by a water jet. Other angles may be used including angles within the range of 90° to 180°. In addition, these angles can be cut by a means other than using a water jet. This step could be done earlier in the manufacturing process depending on the material being used and its corresponding finishing process.

Step 630: Creating recessed channel for the joint (Optional): In this step, a channel is optionally formed on the backside vertical edges by a process that includes, but is not limited to, routering or embossing depending on the building board material. The recessed channels along the backside vertical edges of the building board are preferably added to fit and place the joint.

Step 640: Applying adhesive and the joint: In this step, the adhesive and the joints are applied to the back side of the building board as the building board moves along rolling conveyors. The adhesive is preferably a hot melt polyurethane glue, but can be made from any composition that provides a good bond and adequate shear strength between polymers and cementitious surfaces. The joints may be made from a variety of materials, including fibercement, but is preferably made from a plastic material, such as PVC. The joints may be pre-cut as strips before they are applied to the building board or may be applied directly from a spool. Accordingly, there are alternate ways by which the adhesive and joints can be applied to the building board. For instance, the adhesive can be applied to the surface of the joint strips before the building board and joint strips are pressed together. Alternatively, the adhesive may be preformed on the joint strips in a liquid form or as a self-adhesive strip. The self-adhesive strip could be either attached to the building board during the manufacturing process or in the field during the installation process. In yet another embodiment, the joint strips are attached using various other fastener types such as, but not limited to, screws, staples, or other adhesive means. In another embodiment, the joint strips are sized to fit along the entire back surface of the building board. The joint strips are attached to cover most of the backside of the building board, but are offset from the building board such that the joint strip extends beyond the building board along one edge for joining the building boards.

Step 650: Stacking material: In this step, the finished engineered building material is stacked.

It will be appreciated from the embodiments described above that an improved joint can offer several advantages to a fibercement panel or other type of building board. These advantages are not limited to panels or even fibercement, but can be applied to a variety of building materials as described above.

The shiplapped board described above are preferably configured to provide a rigid connection allowing for load transfers across the joint. The rigid connection of the shiplapped board aids in enhancing the shear strength of the system and the individual boards that make up the system. Although the joint of the shiplapped board is preferably embossed onto the board to conform with the board, the joint may be a separate article that is attached to a surface of the building board.

The articles or joints described above are desirably adhered to the board to provide a pre-fabricated board that simplifies installation of the board over a surface and provides excellent shear strength. For example, the article or joint can provide a nailing or fastening region, and in one embodiment, enables single row nailing of adjacent boards while achieving at least the same shear strength as a joint with two rows of nail at a framing element. In addition, the flexibility of one embodiment of the joint provides for a durable building material that can be easily manufactured, transported, and distributed, and a building material that can relieve stress between building boards caused by differential movement.

The articles or joints described above are also adapted to work with the edge of the building board to which it is adhered to create a locking region for connecting adjacent building boards and ensuring the building boards are properly aligned when nailed to the framing element. Additionally, the building material provides for a joint that does not require caulking to help prevent water seepage between the seams of the building board system.

Although the foregoing invention has been described in terms of certain preferred embodiments, other embodiments will become apparent to those of ordinary skill in the art, in view of the disclosure herein. Accordingly, the present invention is not intended to be limited by the recitation of preferred embodiments, but is instead intended to be defined solely by reference to the appended claims.

What is claimed is:

1. A building material for covering a frame of a structure, comprising:

a fibercement board having opposing surfaces and opposing edges, wherein at least one of said surfaces includes a recessed portion adjacent to one of the opposing edges;

a joint having at least three flanges with at least two hinges interposed between and lying in the same plane with the flanges, respectively, wherein the joint extends beyond at least one of the board opposing edges and is adapted to receive a fastener to fix the board to the structure;

wherein at least one flange is connected to the board recessed portion with an adhesive and at least one flange extends beyond one of the board opposing edges, the at least one extending flange having a resilient bead on its surface and being capable of moving relative to the at least one flange connected to the board recessed portion.

2. The building material of claim 1, wherein at least one flanged and at least one hinge are made of the same material.

3. The building material of claim 1, wherein at least two flanges are integrally formed by a polymeric material positioned along adjacent ends of the first and second flanges.

4. The building material of claim 1, wherein at least one of the flanges is made from plastic.

5. The building material of claim 4, wherein at least two flanges are made from the same material.

6. The building material of claim 1, wherein at least one hinge is made from a flexible material.

7. The building material of claim 1, wherein the extending flange bead is made of a deformable polymeric material.

8. The building material of claim 1, wherein two flanges extend beyond one of the board opposing edges.

9. The building material of claim 1, wherein at least one flange is connected to the surface of the recessed portion by at least one fastener.

10. The building material of claim 1, wherein the adhesive is polyurethane.

11. The building material of claim 1, wherein at least one of the board opposing edges has an edge bevel of 45 degrees or less.

12. The building material of claim 11, wherein the edge bevel is about 30 degrees.

13. The building material of claim 11, wherein both opposing edges each have an edge bevel of 45 degrees or less.

14. A building material for covering a frame of a structure, comprising:

a fibercement board having opposing surfaces and opposing edges, wherein at least one of said surfaces includes a recessed portion adjacent to one of the opposing edges;

a joint having at least three flanges having at least two hinges interposed between the flanges, respectively, wherein the joint extends beyond at least one of the opposing edges and is adapted to receive a fastener to fix the board to the structure;

wherein at least one flange is connected to the board recessed portion with an adhesive and having a resilient bead abutted against the edge of the opposing surface adjacent to the recessed portion opposing edge and at least one extending flange extending beyond one of the board opposing edges and having a capillary break, the at least one extending flange being capable of moving relative to the at least one flange connected to the board recessed portion.

15. The building material of claim 14, wherein at least two flanges are integrally formed by a polymeric material positioned along adjacent ends of the first and second flanges.

16. The building material of claim 14, wherein the at least one flange is connected to the surface of the recessed portion by at least one fastener.

17. The building material of claim 14, wherein at least one of the flanges is made from plastic.

18. The building material of claim 17, wherein at least two flanges are made from the same material.

19. The building material of claim 14, wherein at least one hinge is made from a flexible material.

20. The building material of claim 19, wherein two flanges extend beyond one of the board opposing edges.

21. The building material of claim 14, wherein the adhesive is polyurethane.

22. The building material of claim 14, wherein the capillary break and the at least one extending flange, respectively, are composed of different materials.

* * * * *

UNITED STATES PATENT AND TRADEMARK OFFICE

CERTIFICATE OF CORRECTION

PATENT NO. : 7,600,356 B2
APPLICATION NO. : 10/849279
DATED : October 13, 2009
INVENTOR(S) : Benjamin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 645 days.

Signed and Sealed this

Fifth Day of October, 2010

David J. Kappos

David J. Kappos
*Director of the United States Patent and Trademark Office*